US007096629B1

(12) United States Patent
Cox

(10) Patent No.: US 7,096,629 B1
(45) Date of Patent: Aug. 29, 2006

(54) EXTERIOR WALL CLADDING SYSTEM FOR PANELS OF THIN REINFORCED NATURAL STONE

(76) Inventor: Francis Cox, 40 E. 53th St., New York, NY (US) 10022

( * ) Notice: Subject to any disclaimer, the term of this patent is extended or adjusted under 35 U.S.C. 154(b) by 16 days.

(21) Appl. No.: 10/122,862

(22) Filed: Apr. 15, 2002

(51) Int. Cl.
*E04H 1/00* (2006.01)

(52) U.S. Cl. ..... 52/235; 52/384; 52/43.1; 52/489.1

(58) Field of Classification Search ..... 52/235, 52/489.1, 513, 43.1, 384
See application file for complete search history.

(56) References Cited

U.S. PATENT DOCUMENTS 4,506,484 A 3/1985 Bartlett et al.
4,783,941 A 11/1988 Loper et al.
5,131,378 A 7/1992 Marocco
5,243,960 A 9/1993 Myles
5,339,795 A 8/1994 Myles
5,670,007 A 9/1997 Toncelli

OTHER PUBLICATIONS

RS300 Brochure Thin Stone Systems Marble Technics.

*Primary Examiner*—Basil Katcheves
(74) *Attorney, Agent, or Firm*—Lackenback Siegel, LLP; J. Harold Nissen

(57) ABSTRACT

An installation system designed specifically for thin reinforced natural stone panels used as exterior cladding, re-cladding, or over-cladding of buildings is comprised of a series of extruded aluminum shapes which, when properly applied to the back side of the thin reinforced stone panels, provide structural support for the thin panels and facilitate their installation and will also provide the means for the panels to be pre-assembled in order to obtain desired shapes or profiles and to be easily installed on the building. The series, or family, of extruded aluminum shapes are designed to mate or interlock to perform a variety of tasks such as perimeter frames, structural stiffeners, corner angle supports, interlocking sleeves, runner clips which facilitate attachment to various substrates of a building such as steel stud framing, aluminum curtain wall frames, brick or concrete walls or plywood sheathing.

10 Claims, 16 Drawing Sheets

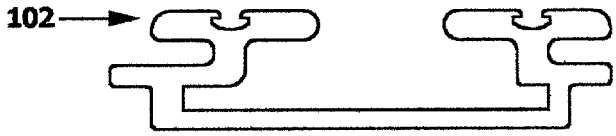
FIG. 2 - Prior Art
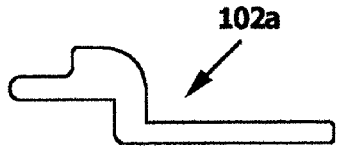
FIG. 3 - Prior Art
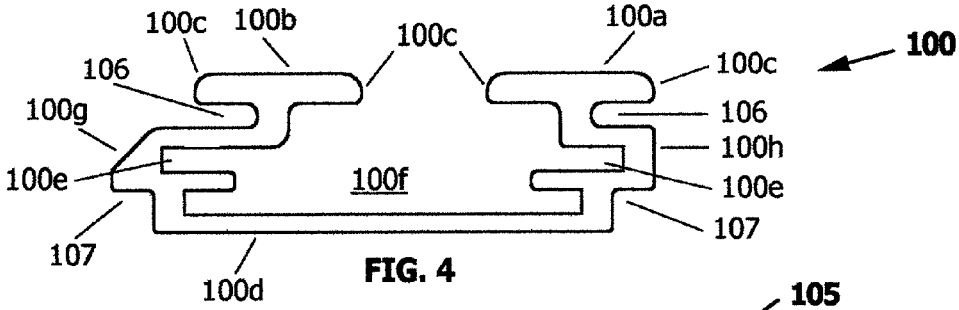
FIG. 4
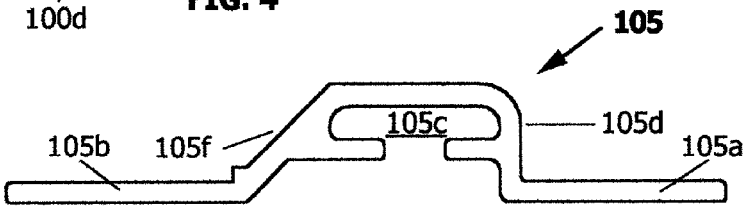
FIG. 5
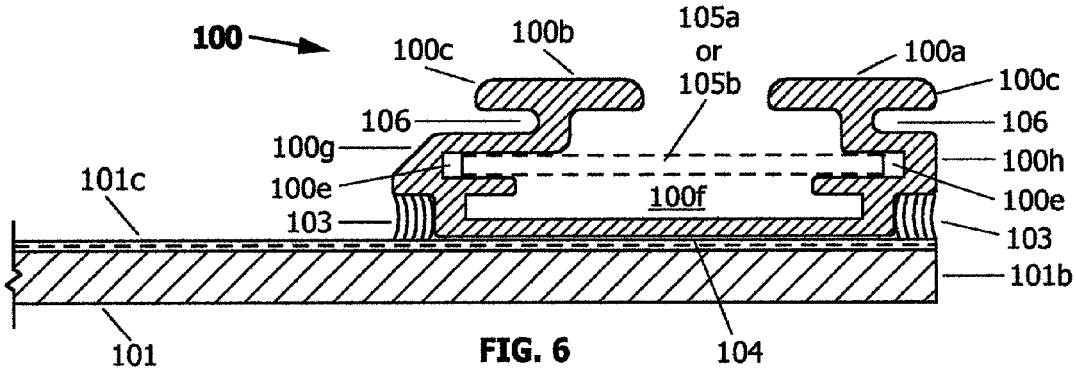
FIG. 6
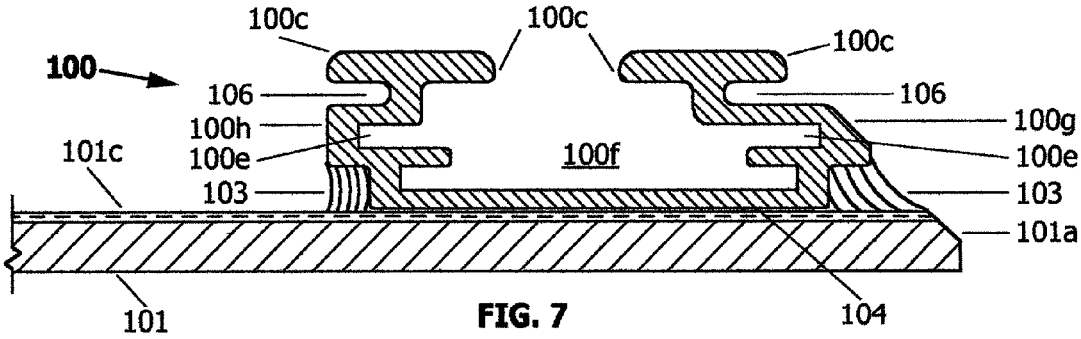
FIG. 7

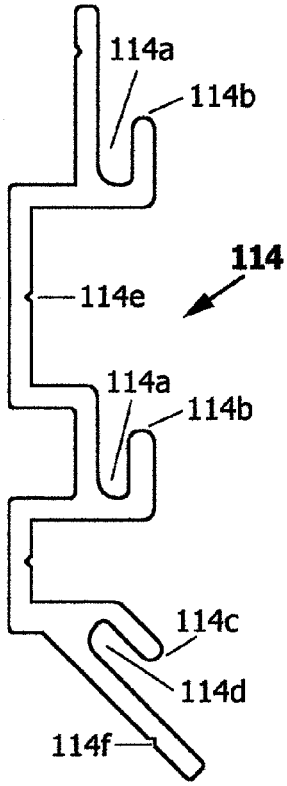
FIG. 14
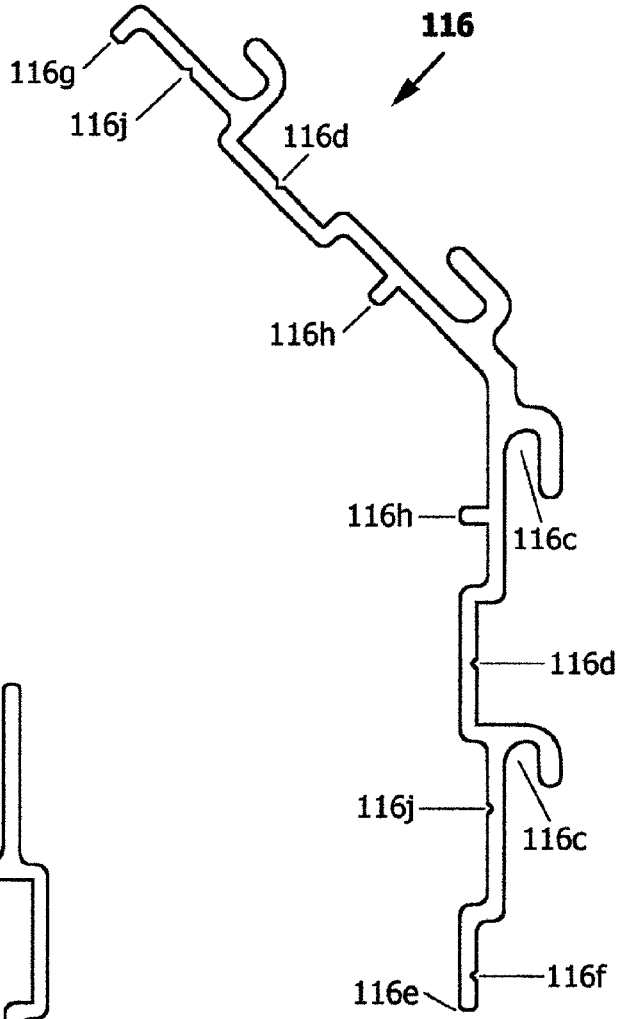
FIG. 16
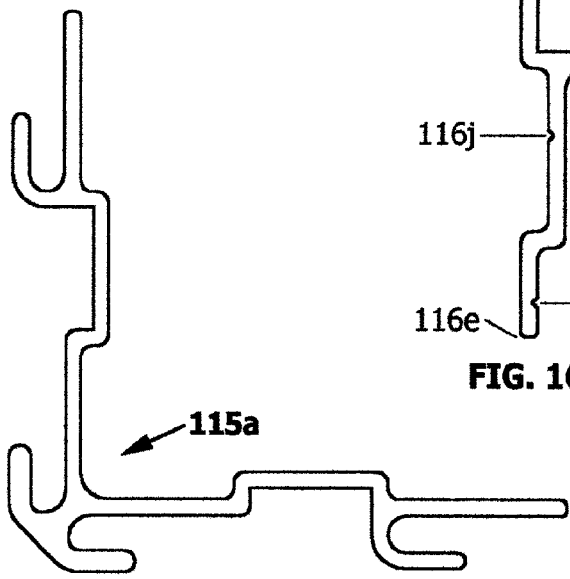
FIG. 15a - Prior Art
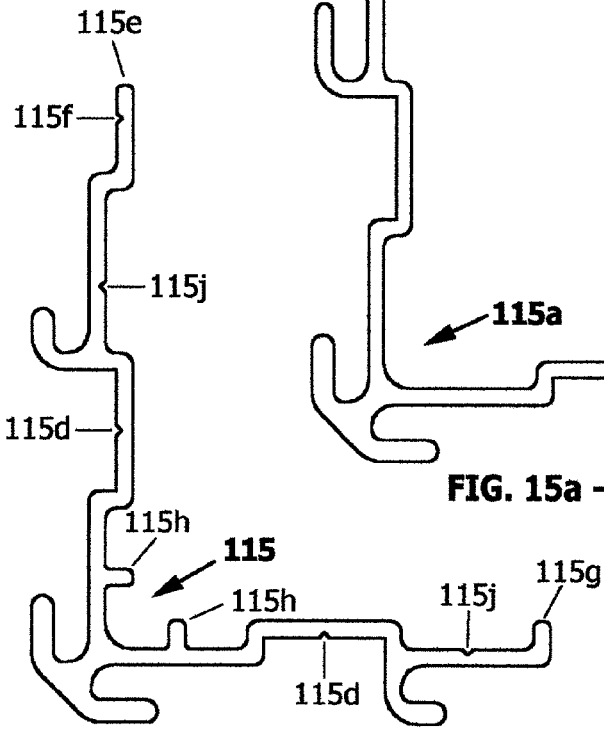
FIG. 15

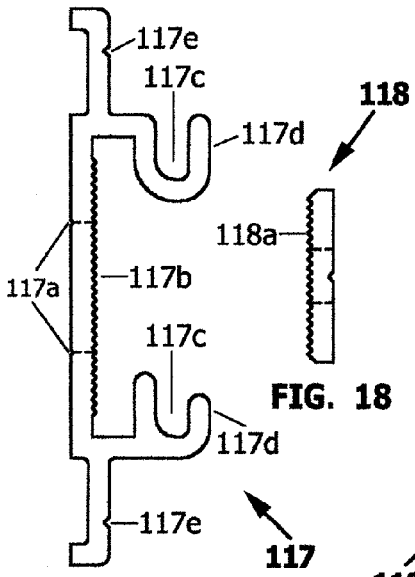
FIG. 18
FIG. 17
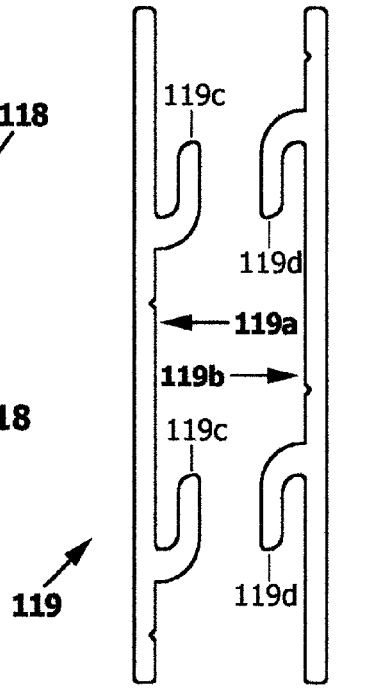
FIG. 19A FIG. 19B
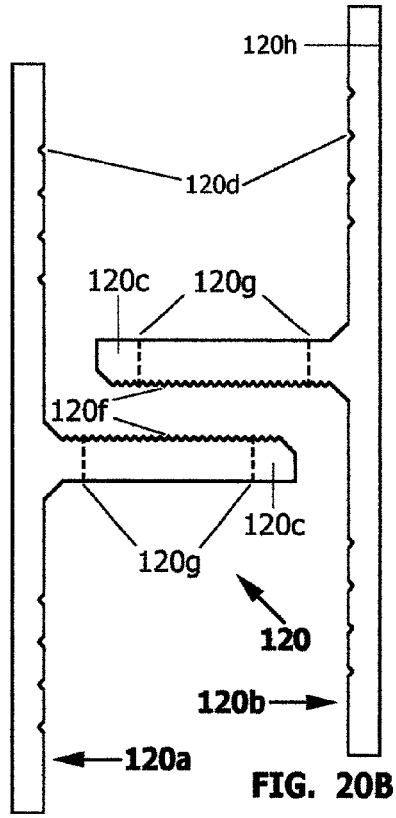
FIG. 20B
FIG. 20A
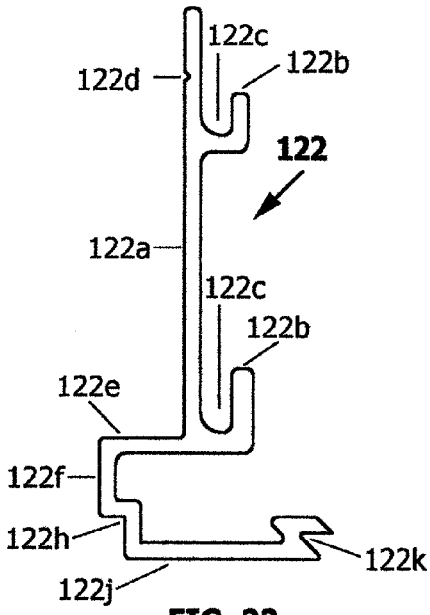
FIG. 22
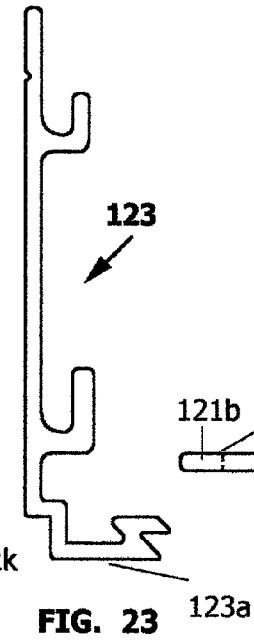
FIG. 23
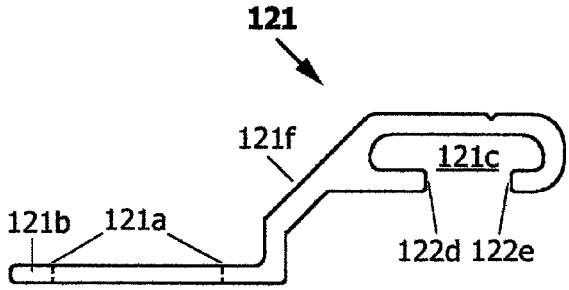
FIG. 21

140a
140b
101
100
101
100
115
142f
142f
142e
142d
115e 101
140b
140a
109
109a
112d
112
100
101

144a
115
100
101
144a
100
140a
140b
101
140b
140a
101

EXTERIOR WALL CLADDING SYSTEM FOR PANELS OF THIN REINFORCED NATURAL STONE

FIELD OF THE INVENTION

The present invention relates to a system to clad exterior walls, having both uniform and non-uniform shape, more particularly the invention is concerned with a cladding system for cladding commercial and institutional buildings, new or existing, using panels of thin lightweight reinforced natural stone, either marble, granite, or limestone.

BACKGROUND OF THE INVENTION

Since ancient times natural stones, particularly granite, marble, and limestone, have been preferred materials for cladding exterior walls of buildings. Today there are various conventional methods of cladding exterior building walls with natural stone. The conventional cladding usually employs panels of stone 1¼" (16 psf) to 2" (26 psf) and sometimes 3" (39 psf) and 4" (52 psf) thick whose weight (herein termed the dead loading, a term commonly used in the industry) must be carried by relieving angles or shelf angles which are attached to the building structure by mechanical means. The aforementioned weights (pounds per square foot or "psf") are approximate and vary with the type of stone.

The resistance to lateral loading (herein termed the live loading) is usually accomplished by stainless steel clips, dowels or anchors inserted into kerfs or holes drilled or cut into the edges of the stone panels and connected to the building structure by mechanical means thus providing the essential mechanical connection between the stone and the structure. A structural weak point in the conventional stone construction occurs at these kerfs or anchor holes in the edges of the stone slabs and they must leave enough stone thickness to provide sufficient strength within the remaining stone thickness to resist the various wind, seismic and atmospheric pressures (live loads), both positive and negative, which will be exerted on the stone panels by forces of nature as well as stresses applied during construction handling.

Calculation of this strength is an inexact engineering task since the stone is a product of nature and properties vary from stone to stone and piece to piece. Different types of stone have different physical and structural characteristics. Weak points or hidden fractures are sometimes difficult to visually ascertain in a material such as natural stone. Mechanical values and properties of the stones used for structural or engineering calculations are obtained by means of empirical testing in laboratories and field testing on samples of particular stones and the resulting values used for structural calculations usually include a substantial safety factor in order to compensate for the unpredictability of designing with natural stone. In the design of conventional stone work, these calculations determine the thickness of stone to be used or the frequency of anchors in the edges of the stone panels. As the load factors go up the stone thickness is usually increased to add strength.

The fixing method described above for individual stone panels is often used in a pre-assembly of multiple stone panels of thickness of 1¼" thick or greater affixed to a prefabricated steel frame or truss made up of structural steel angles, channels, beams, or steel studs to form a structural unit perhaps one or two stories high and various widths usually from column to column. This system is generally referred to as a "truss" or "strong-back" system. These preassembled, or prefabricated, panels can sometimes include windows. This method offers economies of factory assembly and rapid erection time at the jobsite. In another method sometimes used in high rise curtainwall cladding the panels of stone can be incorporated into the aluminum window framing usually by means of inserting a flange of the aluminum frame into a continuous slot which has been cut into the edge of the stone panel. This is usually referred to as a "glazed-in" system. The stone thickness for this method is usually 1¼" or greater and the aluminum window frame must be structurally designed to carry the substantial weight of the stone panel. A disadvantage of this traditional method of fixing is the vulnerability of the stones to breakage which can occur during construction handling or from various forces such as structural movements caused by earthquake or other factors. Also it could be somewhat difficult to replace a stone panel in the event of damage or breakage without replacing the complete window frame.

Once the stone panels are set in place on the building wall by various methods as discussed above, the joints between adjacent stone panels and between stone and window frames are usually sealed or caulked with an elastomeric sealant in order to form a weather tight exterior wall surface. This is generally referred to as the "wet seal" method and in order to assure the critical watertight integrity of the facade it is necessary to provide a suitable pocket between panels for the application of the caulking sealant. This caulking process requires a depth of about 1" in the joint to allow the placement of a compressible polystyrene backer rod to the correct depth in the joint cavity in order to provide a stopper for the sealant. The conventional systems using stones 1¼" and 2" thick provide adequate joint depth for this caulking method.

There have been other methods of attaching the thicker traditional stone to a prefabricated structural frame as described in U.S. Pat. Nos. 5,239,798 and 5,379,561 both issued to Saito in 1993 and 1995 respectively wherein threaded studs or bolts are fixed into undercut holes on the backside of the stone panel but this method has not been widely used as there are many disadvantages to this system.

Another prior art method to use a thinner stone veneer on a prefabricated panel is described in U.S. Pat. No. 4,506,482 issued to Hans J. Pracht et al in 1985. In this method the structure consisted usually of a steel stud frame wall with an attached metal decking platform to receive the facing veneers which were generally tiles of various materials and dimensions and which were resiliently bonded to the steel decking with a structural silicone. The silicone adhesive was the sole support and attachment of the facing veneer for both the dead loads and the live loads. In the case of natural stone, it was necessary to reduce the dead weight as much as possible. Therefore the stone veneers often consisted of tiles of small thickness such as ⅜" or ½" and small dimensions such as 12"×12" or 16"×16". To use larger dimension panels it was necessary to use thicker slabs such as ¾", 1", or 1¼" usually with a shelf angle to carry the extra weight. The U.S. Pat. No. 4,783,941 issued to William Loper et al in 1988 and commercialized as the "Cygnus Panel System" was considered an improvement over the previously mentioned U.S. Pat. No. 4,506,482 and essentially added metal clip attachments usually in kerfs in the edges of the stone panels which were then connected to the steel decking on the panel structure. This provided a positive mechanical connection to the structure in order to carry the extra weight which was useful in situations where building codes require mechanical connections between stone veneer and building structure.

Both of these methods are comprised of a prefabricated structural panel with a plurality of veneer panels. As such, there are inherent limitations in the flexibility or adaptability of this type of panel to resolve many of the design conditions found in today's building facades. While this type of panel can be useful for new construction, and particularly for mid to high-rise buildings, it has a very limited use in renovation work. A major contribution of these methods lies in the advancement of the use of structural silicone adhesive as a means of resilient attachment of stone in building facades. The silicone adhesive has been in accepted use for more than 40 years to attach large panes of window glass on high-rise building curtain walls. But primarily because of the excessive weight of conventional stone panels this adhesive was not heretofore widely used to support stone on building facades.

Another prior art method of exterior cladding with stone involves lightweight panels made up of a very thin veneer of stone which is adhered with epoxy to a sandwich panel of aluminum honeycomb between two layers of fiberglass. A method of fabricating these panels is discussed in U.S. Pat. Nos. 5,243,960 and 5,339,795 issued to Peter Myles in 1993 and 1994 respectively and they are presently commercialized by Stone Panels Inc. These panels are about 1" thick and are usually installed on a building facade by means of a modified aluminum C-shaped clip or interlocking channel attached to the back of the stone faced honeycomb panel with an epoxy set threaded insert. This channel interlocks with matching aluminum runners which are installed on the building and the panels are hung on the runners. One potential problem with this system is the fact that the very thin veneer of stone, only about 3/16" thick, is adhered to the honeycomb panel only by the epoxy adhesive and could possibly delaminate over time due to constant exposure to the elements or the differential expansion between stone and the fiberglass covered honeycomb panel due to thermal extremes. A second potential problem is the inability to provide a positive mechanical connection between the very thin stone veneer, only 3/16" thick, and the building structure which would keep the stone from falling in the event of delamination. A third potential problem is that epoxy can weaken under excessive heat or fire and the epoxy set threaded inserts which support the attachment clips could become ineffective.

There have been recent and significant technological developments in the manufacture of thin stone panels which result in slabs with a thickness of only 5/16" (7 mm+) or 3/8" (9 mm+) which are reinforced with nettings of fiberglass or expanded steel mesh bonded to one face of the stone slab with epoxy in a vacuum or impregnation process. These thin reinforced slabs are produced in the full block sized dimensions up to about 5 ft. by 10 ft. which is a limitation imposed by the common practice in the stone quarrying industry of extracting and cutting blocks of raw stone into cubic shapes measuring approximately 5' by 5' by 10'. These cubic shapes fit into the stone gangsaws which are standard in the industry and which transform the cubic blocks into slabs. When they are polished the thin reinforced stone panels present the outward appearance identical to the much thicker slabs 1¼" and 2" thick as used in conventional construction. At present these thin panels are produced by two different Italian manufacturers using different manufacturing processes and may be referenced by U.S. Pat. No. 5,670,007 issued to Marcello Toncelli, inventor, on Sep. 23, 1997 and entitled "Process For The Production Of Reinforced Slabs Of Stone Materials" and by U.S. Pat. No. 5,131,378 issued to Giuseppe Marocco, inventor, and assigned to Tecnomaiera S.r.l., Italy, on Jul. 21, 1992 and entitled "Method For The Production Of Reinforced Panels From A Block Of Building Material, Such As Stone".

These thin reinforced panels of stone, either marble, granite, or limestone, can be used directly in small dimensions on interior surfaces as flooring tiles or wall paneling applied with various types of adhesives as in conventional construction. The mechanical properties of the thin reinforced panels are generally superior to those of unreinforced thicker stones as used in conventional construction. The reinforcing process transforms the thin sheet of brittle stone into a strong, lightweight, non-brittle (ductile) and impermeable panel which is well suited for use as exterior building cladding. But while the thin reinforced stone has found a widespread market for inteior use as floor tiles and wall paneling, it has not seen the same success in the field of exterior wall cladding. In order to find a wider market and to be successfully utilized on exterior walls, the thin stone must be incorporated into a wall system which is compatible with today's construction methods. The present invention addresses and solves this problem.

For exterior cladding there are obvious advantages in the use of thin reinforced stone panels only 3/8" thick, weighing only 5.5 psf, instead of the much heavier conventional unreinforced stone 1¼" or 2" or even 4" thick weighing from 16 to 52 psf. Among these advantages are the reduction of jobsite labor and general construction time and overhead because of the ease of handling due to the lightness of weight, and the savings in construction due to less weight being imposed on the building structure. The challenge is to adapt the thin lightweight reinforced stone panels to the methods of building construction, particularly exterior wall cladding, which are in use today in the industry and to make them structurally resistant and accommodative to the external forces of wind loading and movements due to temperature variations and the seismic forces which they could be subjected to when used on the facade of multi-story buildings. The present invention addresses these challenges and provides greater utility and the opportunity for a far wider usage of the thin reinforced stone panels on the construction market.

The present applicant and inventor of the current invention, has previously invented a simple framing system to enable the thin reinforced stone panels to be utilized in curtain wall construction and this was commercialized under the trade name "RS300 Wall Cladding System". This system was developed several years ago while applicant was employed at Marble Technics Ltd., a USA division of an Italian company, Tecnomaiera S.r.l., one of the developers of the thin reinforced slabs previously referred to above re U.S. Pat. No. 5,131,378 issued to Giuseppe Marocco. Marble Technics ceased operations in 1996 The present invention is an improvement over the prior RS300 system, which was never patented, and addresses a much wider range of possible uses in the art of building construction. It is a much more highly developed wall system.

The RS300 Wall System consisted primarily of a basic extruded aluminum shape which performed as a perimeter frame for the panel as well an intermediate structural stiffener. The frames are adhered to the back face of the stone panel by means of high performance structural silicone. The perimeter frame, while providing structural reinforcement, also provides protection for the thin vulnerable edges and corners of the stone panel as well as a means of attachment to the building structure by use of mating clips which are nested into the frame shape and are connected in turn to the building structure or the curtain wall frames by mechanical means such as screws. After a limited amount of actual use in the field it became obvious that the RS300 System, in its basic simple format, had serious shortcomings. The system was conceived for use primarily in simple flat panel curtain wall facades and to be incorporated into existing aluminum curtain wall systems. The 1" total thickness of the stone panel and frame together were intended to match and be interchangeable with the 1" thickness of typical double glazing panels commonly used in most curtain wall facades so that both stone and glass could be used in the same glazing frame. It is now realized that the architectural design requirements of today's buildings, particularly the smaller low-rise suburban office buildings, are much more diverse than the simple flat panel facades. This is especially true when the problem is to renovate by recladding or overcladding an existing facade without necessarily removing the existing facade. The light weight of this thin stone cladding system very often makes such an approach structurally feasible and economically desirable.

Architects are designing more complex profiles into their building exteriors in the cornices, parapets, copings, sills, returns, column covers, etc. In conventional construction these more complex profiles are achieved with traditional stone using 1¼" and 2" thick slabs and sometimes with even more massive pieces by employing various metal clips in the edges of the thicker stone attached to back-up support frames usually of structural steel and sometimes using epoxy adhesives to cement stone pieces together to achieve the desired results. The basic RS300 system does not have the capability to reproduce the many features and profiles required to solve the various design problems. To reproduce the wide variety of profiles found in architectural designs the thin ⅜" reinforced stone requires a specially designed system with adaptability and flexibility to achieve desired results and produce the same visual effect as the thicker traditional stone and this is the objective of the present invention which is an improvement over the RS300 system and which takes into consideration the problems of the current architectural designs which the prior art system is unable to do.

Other shortcomings of the RS300 system were structural in nature. As previously discussed, the basic aluminum perimeter frame was designed to be slightly more than ⅝" thick in order to combine with the thickness of the stone panel to reach a combined total 1" thickness in order to match the 1" thickness of the double glazing panels. However, this was an objective that turned out to have little value because that particular requirement was most infrequent. The finished panel could pass required structural tests but the allowed bending under pressure was greater than desirable which was a factor of the bending strength of the ⅝" thick perimeter frame of the RS300 system. Another weakness occurred at the corner intersection of the perimeter frames. The interlock clip, which was designed to provide a structural connection between the two perimeter frames at the corner intersection or between a perimeter frame and a stiffener, allowed excessive movement away from the plane of the panel which could produce a bending along the inside line of a perimeter frame at the intersection. This was a defect in its design which could cause fracture in the stone when the panel was subjected to bending pressure due to the live loads or stresses during handling, lifting, packing, and transportation. Another shortcoming occurred with the two-piece panel clamp which was designed to provide a positive mechanical connection between the stone panel and the aluminum frames. This panel clamp turned out to be excessively complicated and difficult to properly install and therefore proved to be ineffective.

In summary, the original RS300 system did not contain sufficient flexibility and scope to solve the many building facade problems which can be encountered in actual practice and moreover it had some structural weaknesses which need to be addressed. The present invention is an improvement over the prior RS300 system and an extension of its capabilities while maintaining its basic concept.

BRIEF SUMMARY OF THE INVENTION

Natural stone, particularly granite and limestone, are preferred cladding materials in the industry for exterior walls of buildings which are normally utilized in conventional construction with slabs of 1¼", 2" and sometimes 3" and 4" thick. Recently developed technology and manufacturing processes (U.S. Pat. Nos 5,670,007 and 5,131,378 referred to above) produce slabs of reinforced stone as thin as 5/16" (7 mm+) or ⅜" (9 mm+) and as large as 5 ft. by 10 ft. which weigh only 4.5 to 5.5 psf as opposed to the thicker conventional slabs mentioned above weighing from 16 to 52 psf depending on the thickness and type of stone. The thin reinforced slabs offer some substantial benefits and economies in the design and the construction process. Obvious benefits are reduction in weight to the structure and the ease of handling the lighter weight panels which saves construction time on the jobsite which in turn reduces jobsite labor costs. These thin slabs are reinforced during their manufacturing process with nettings of fiberglass or expanded steel mesh bonded and impregnated with epoxy. When used in large sizes these thin panels will have some flexibility with a tendency to bend under pressure of the live loadings. In order to prevent cracking or breaking, the thin panels must be structurally supported in such a manner to sufficiently resist the various bending forces.

The present invention is an improvement over the RS300 system and its primary purpose is to provide a wall system which incorporates the thin reinforced stone of 5/16" to ⅜" thickness on exterior walls of buildings, both low-rise and high-rise, in new construction and in the renovation of existing buildings. When compared with the prior art, the present invention is stronger, more secure, more resistant to external live loads, and more capable and versatile in solving the many facade profile problems encountered in today's buildings.

The present invention supports the use of any size panel up to 5 ft. by 10 ft. which is a limitation imposed by the size of quarried blocks of natural stone. This very versatile wall system consists of a series of specially designed extruded aluminum shapes which, while specially designed, have unique structural features in common. Some of these shapes are mounted on the backside (the reinforced side) of the thin stone panels with structural silicone and perform as perimeter frames and structural stiffeners. Others are attachment clips which serve to connect some panel sections together in a pre-assembly or to provide support when panels intersect at various angles or to attach the panels to the building substrates which are generally steel stud framing, brick or concrete walls or plywood sheathing. Other shapes serve as anchoring clips to anchor the panels to the building structure. The shapes are designed to mate with or attach to each other sometimes joined by screws and sometimes simply nested together, a feature which allows for some movement in the building facade which may be due to forces exerted by wind, temperature differentials, or seismic forces.

Once properly assembled and installed on a building facade, the thin stone panels with the aluminum framing members and stiffeners become self-contained structural units which provide the necessary strength and stiffness to resist the various windload factors as required by building codes. Panels can be combined in a pre-assembly to create various shapes and profiles to facilitate the installation process. Anchorage to the building structure is provided by the clips connecting to the mating runners or clips mounted on the building substrate. The structural design of the framing system can be easily adapted to resist the higher windloads where required without materially affecting the cost of the system. This structural accommodation is a simple function of engineering design and adjusting the spacing of the stiffener frames and the clip attachments. The stiffeners can be spaced closer together for the higher wind-load conditions. The attachment clips and anchor clips serve to transfer loads from the panel to the building structure. Their spacing can also be adjusted to accommodate different wind-loads. The reinforcement layers which are bonded to the stone, either fiberglass nettings or expanded steel mesh embedded in epoxy, impart a degree of consistent structural predictability to the thin stone panel which does not exist in the thicker but unreinforced slabs used in conventional construction which can have a quality of brittleness. This predictability along with the known structural values of the aluminum extruded shapes acting as perimeter frames or stiffeners allows engineers to design with a certain amount of confidence rather than relying on empirical testing and large safety factors as with conventional stone design. Another security feature of the thin reinforced panels is that when subjected to an unusual force impact, the panel does not necessarily shatter into pieces like traditional thicker unreinforced stone but instead is likely to remain intact even though cracked and broken, a reaction similar to safety glass. The reinforcing membrane will tend to retain the broken stone pieces rather than let them fall.

The present invention is able to overcome the structural and the design shortcomings of the RS300 system. The basic perimeter frame according to the present invention offers more structural support than the prior system. The frame according to the invention is deeper by ¼" and wider by ¼" with more aluminum metal at the outer edges all which contribute to its increased strength and rigidity. These changes result in an increase in the value of the Section Modulus to 0.239 versus a value of 0.128 for the prior art, an 87% increase. These values are in inches to the 3rd power. The Moment Of Inertia is increased to 0.114 versus 0.045 for the prior art, a 153% increase. These values are in inches to the $4^{th}$ power. In order to quantify the improvement in the structural value of the frame of the present invention, a structural calculation can be made considering the frames as simple beams supporting a uniformly distributed loading over its length, and it is found that the deflection of the prior art frame is more than 150% greater than that of the present invention. More strength in bending and stiffness allows the stiffeners to be placed further apart thus creating a more balanced resistance to deformation between the aluminum frames and the thin reinforced stone panels.

Another improvement over prior art is a novel method of making the structural connection at the intersection of the perimeter frames at the corners in such manner to reduce the possibility of a bending movement between the intersecting frames away from the plane parallel to the face of the stone panel. Such a movement, if excessive, could cause fracture in the stone. In the present invention, the splice-connector clip is designed to provide a much stronger, stiffer, and a more positive connection between the two intersecting frames than the interlock clip of the prior art. The mid-section of the splice-connector envelops one of the two flanges of the perimeter frame while its two extended legs penetrate the female sockets of the internal space of each of the intersecting frames in such manner to maintain the structural integrity of the intersection in the plane parallel to the stone panel while allowing some slip-movement in the plane of the panel along the parallel axis of each frame. The prior art did not provide the same degree of structural and planar integrity.

Another improvement over the prior art is a different method of providing a positive mechanical connection between the thin stone panel and the building structure. Many building codes require a positive mechanical connection between a stone fascia panel and the building structure. This requirement was addressed in the prior art by the two-piece panel clamp which turned out to be extremely difficult to install properly. Getting the two opposing angled sawcuts in exactly the correct position and proper depth to hold the two pieces of the clamp bolted together and then attach them to the perimeter frame proved to be very difficult but also very time consuming and costly. The present invention resolves this problem with a different approach using a special expansion bolt designed for use on thin slabs of materials such as glass, ceramic tiles, and stone. The expansion bolt is set in an undercut hole which has been drilled with a special drill creating a shallow bell-shaped hole on the backside of the thin stone panel and is fastened to a connecting clip which is locked onto a flange of a perimeter frame of the panel which, in turn, is positively attached to the building substrate thus completing the mechanical connection between stone and structure. This procedure is simpler, quicker, easier and less costly than that of the prior art.

Another advantage of this wall system is the ease of replacement of any panel which may be damaged. A single panel can be removed and replaced. Or in some cases the removal of two panels may be required. That process is not so easy in conventional construction using heavier slabs. The erection process of the panels of the present invention is non-directional as opposed to progressive as with most conventional stone construction where one panel must be put in place before the next panel can be installed. In the present invention, panels can be installed independently and proceed in any direction which is very advantageous to the installing contractor.

In the present invention, the system is designed to facilitate the "wet seal" method of facade construction in which the watertight integrity of the wall is crucially dependent on obtaining watertight seals at the joints between panels. The system, by its design, provides for the correctly sized pockets at the panel joints as necessary to obtain proper caulked joints.

The basic objective of the present invention is to take advantage of the remarkable new technology in the stone industry which produces the thin reinforced sheets of natural stone and to provide an improved structural support system whereby the thin reinforced stone slabs can be safely, efficiently, and economically utilized as exterior wall cladding for new construction and recladding or overcladding for the renovation of existing buildings. The lightness of weight due to the reduced thickness of the thin reinforced panel allows its use in many situations where the heavier traditional stone cannot be considered. This is particularly true in renovations because of existing structural and weight limitations which could preclude the use of heavier conventional stone construction. In many parts of this country workmen skilled in the art of masonry and stone construction are no longer readily available. An advantage of this invention is the simplicity of installation wherein basic carpentry skills are adequate to perform the task of installation.

To these ends, the present invention is concerned with a wall cladding system. More particularly, the invention is concerned with a wall cladding system which is an improvement over the prior art and is a for covering an exterior building wall, and includes thin reinforced natural stone which is supported by the wall cladding system, and comprises framing means for supporting panels, each of the panels include a thin natural stone element connected with the framing means for attachment thereof to the exterior of a building wall; the framing means includes framing members for supporting a multiplicity of the panels arranged in a closely spaced relationship for defining both vertical and horizontal joints between adjacent panels, and the multiplicity of panels include a plurality of planar panels each having a plurality of linear edges, each planar panel has a principal wall forming a portion of the exterior building wall formed by the wall cladding system; each of the framing members comprise a top frame member, a bottom frame member and two side frame members, and each of the frame members have shapes and profiles constructed of extruded aluminum; each of the planar panels have a facing sheet of thin reinforced natural stone which is adhesively bonded to the framing members with a double bite of silicone adhesive; the framing means includes slip connection means and two extended legs of a clip which fit into female sockets of an interior space of members forming intersecting framing members for structurally connecting the framing members at the corners of the panel with a slip connection member, each slip connection member permitting controlled movement in the plane of the panel and along the axis of each of the intersecting framing member while maintaining a substantially rigid planar relationship between the intersecting framing members formed by the insertion of the two extended legs of a clip into the female sockets of an interior space of each of the intersecting framing members while a mid-section of the clip envelops one of the flanges of the intersecting framing members; each of the framing member has a top portion, an interior space and a flat bottom section for contacting the thin reinforced natural stone, and includes two flanges provided at the top portion of the framing member oriented in the same plane as the face of the planar panel and separated by a space which opens to the interior space of the framing member, and the framing member includes two outside edges, one of which is perpendicular to the face of the planar panel forming a flush edge, and an opposite edge forming an angle with the face of the planar panel defining a rebate edge, and both edges include female sockets for the purpose of engagement with other external devices and have two lower outside corners recessed to receive beads of silicone adhesive to implement an adhesive connection between a facing sheet and the framing members so that the framing members at the edges of the planar panel provides structural support and resistance to deformation due to lateral live loads such as wind and seismic forces as well as physical protection for vulnerable edges and corners of the natural stone which is formed of thin fascia sheets; and the planar panel has a perpendicular wall formed at an outside edge of said framing member with the flush edge of the framing member positioned flush with the edge of a fascia panel and the facia panel being situated closely to the adjacent panel, the flush edges of the two panels together create a pocket between them of sufficient depth to provide a space for a backer rod of a compressible polystyrene circular rope to be inserted into the space between two of the adjacent panels for the caulking sealant to be applied during construction to create a watertight joint between the adjacent panels.

The wall cladding system of the present invention is also concerned with the support of panels formed of thin reinforced natural stone, each panel comprises framing means and a facing sheet of thin reinforced natural stone, and the system includes the framing means which includes framing members forming a frame for supporting a multiplicity of the panels arranged in a closely spaced relation for defining both vertical and horizontal joints between adjacent panels, the multiplicity of panels include a plurality of non-planar panels each having a plurality of linear edges, each panel has a principal wall forming a portion of an exterior building wall; each of the framing members comprising a top frame member and a bottom frame member and two side frame members, each of the frame members have shapes and profiles which are constructed of extruded aluminum; each of the non-planar panels including the facing sheet of thin reinforced natural stone adhesively bonded to the frame members with a double bite of silicone adhesive; slip connection means or slip connectors for structurally connecting the framing members at corners of the panel with a slip connection member to form intersecting framing members which allows movement of the panel along the axis of each intersecting framing member while supporting a rigid planar relationship between the intersecting frame members formed by the insertion of two extended legs of a clip into female sockets of an interior space of each of the intersecting frames while a mid-section of the clip envelops one of the flanges of the intersected frame; each of the framing members being characterized by having a flat bottom section for contacting the thin natural reinforced stone, and two flanges provided at the top of the frame oriented in substantially the same plane as the face of the panel faces and separated by a space which opens to an interior space of the frame, and the frame having two outside edges, one of which is perpendicular to the face of the panel forming a flush edge, and one of the opposite edges forming an angle with the face of the panel defining a rebate edge, and both of the edges including female sockets for the purpose of engagement with other external devices and having two lower outside corners recessed to receive beads of silicone adhesive to implement an adhesive connection between the face of the panel and the frame so that at least the bottom framing member of the framing members at the edges of the panels provide structural support and resistance to deformation due to lateral live loads such as wind and seismic forces as well as physical protection for the vulnerable edges and corners of the thin reinforced stone; the framing members at a linear edge form an angled intersection of two non-planar panels to form intersecting panels being oriented to present the rebate edge of the framing members toward the panel edge and, when engaged with an attachment clip, will position the intersecting panels in desired relative locations with respect to each other; an attachment clip for positioning of the intersecting panels by engaging the framing members of the intersecting panels with the attachment clip, made of extruded aluminum, with the respective sockets and flanges of the frames and the clip meshing in a nesting reciprocal male/female engagement which automatically positions the intersecting panels in the correct relationship; the attachment clip also controls the angled intersection of the intersecting panels and the angles and shapes of the various attachment clips which nest with the flanges and sockets of the framing members in a reciprocal male/female engagement whereby correct positioning of the intersecting panels is achieved through a dimensional coordination of the specific placement of a rebate edge framing member on the backside of a facing panel with a specific profiled edge finish applied to the edge of the thin natural stone panel in order to produce a required panel intersection; and the attachment clips automatically positions two intersecting panels to form a pocket between the panels of sufficient size and depth for the insertion of a compressible polystyrene circular rope to serve as a backer rod for the application of the caulking sealant which creates a watertight joint between panels.

Another feature of the invention is that each panel includes a stiffener member extending between and connected to opposite framing members by means of a splice-connector clip and being adhesively bonded to a back face of the facing panel, and the stiffener is composed of a similar framing member as used at the periphery of the panel and provides for resistance against deflection due to lateral loading caused by high wind pressures, both positive and negative.

Another feature of the invention is that the profile shape of the basic panel framing member can vary in order to meet various conditions of panel intersections such as outside and inside angles and dimensional requirements of smaller panels and returns.

Another feature of the invention is that attachment clips are utilized to create connections and attachments between one of the panels with another panel. The attachment clips can include male flanges and female sockets which engage in male/female nesting with the framing members for supporting the required intersection of the framed panels in the correct relationship for automatically creating a desired joint condition.

The attachment clips may also be utilized to pre-assemble in a shop the framed panels with other smaller panel sections to create various panel profiles including edge returns, sill returns, jamb returns, soffit returns, column cover returns, all by means of locking engagement, secured by screws, of the flanges and sockets of the panel frames and attachment clips.

The attachment clips may also be utilized to pre-assemble in a shop an edge return on a framed panel with the intersecting stone edges cut in a full miter and brought to a tight joint filled with epoxy adhesive to create a virtually invisible miter joint in order to simulate a thicker conventional slab of stone as much as 4" thick all by means of the structural support of a locking engagement of the flanges and sockets of the panel frames and the attachment clips as secured by screw attachment.

To these ends, a further feature of the present invention is in that a mechanical connection can be achieved when required and may be provided to supplement the adhesive bond between the stone panel and the structure represented by the structural framing member on an edge of the panel by means of an anchor clip for providing a bridge connection between an undercut expansion bolt installed in the back face of the thin stone panel and a flange of a framing member of a panel by enveloping the frame in a manner that permits a slip movement in order to compensate for any movement due to expansion or contraction caused by temperature differentials.

A further advantageous feature of the invention is that the framed panels are self-contained structural entities and include anchoring clips anchoring the panels loosely to a building substrate, runners are provided attached to the building in such manner that can allow or permit some horizontal sliding movement in the sockets and flanges of the panel frames and the various anchorage and attachment clips in the event of building sway movement due to high wind or seismic forces.

The framed wall panels are anchored to the building substrate by double-hook horizontal runners and clips which matingly engage with the panel frames by means of male/female interlocking of the flanges, runners and clips.

Periphery frames and stiffeners are initially bonded to the back face of the thin stone panel with a double-face industrial tape prior to the application of the double bite of structural silicone adhesive on each framing member.

Another feature is that the frames, clips, and anchors feature a double-bite/double-hook structural balance principal in the various mating and interlocking engagements.

It should be noted that the attachment clips are utilized to pre-assemble in a shop an edge return on a framed panel with the intersecting stone edges cut in a full miter and brought to a tight joint filled with epoxy adhesive to create a virtually invisible miter joint in order to simulate a thicker conventional slab of stone as much as 4" thick all by means of the structural support of a locking engagement of the flanges and sockets of the panel frames and the attachment clips as secured by screw attachment.

BRIEF DESCRIPTION OF THE DRAWINGS

FIG. 2 is an end view of the basic perimeter frame of the prior art—the RS300 system.

FIG. 3 is an end view of the interlock clip of the prior art—the RS300 system.

FIG. 4 is an end view of the basic perimeter panel frame of the present invention.

FIG. 5 is an end view of a splice-connector clip used at the corner intersection of two panel perimeter frames, according to the present invention.

FIG. 6 is a sectional end view showing the flush edge of a perimeter frame when positioned on the panel edge.

FIG. 7 is a sectional end view showing the rebate edge of the perimeter frame when positioned on the panel edge.

FIG. 14 is an end view of another embodiment of a connector clip which supports an angled intersection of two panels to form an inside corner of 135 degrees.

FIG. 15 is an end view of another embodiment of a connector clip which supports an angled intersection of two panels to form an outside corner of 270 degrees FIG. 15A is an end view of a prior art corner clip.

FIG. 16 is an end view of another embodiment of a connector clip which supports an angled intersection of two panels to form an outside corner of 135 degrees.

FIG. 17 is an end view of one embodiment of an anchoring clip to be installed on a building substrate with its inside surface serrated and contains two female sockets to support the flanges of two wall panels meeting on the same plane.

FIG. 18 is an end view of a flat washer with one surface serrated.

FIG. 19A is an end view of a double hook anchoring clip with hooks turned up when used as a clip or runner and attached to the building substrate FIG. 19B is an end view of a double hook anchoring clip with hooks turned down when attached to the frames of a panel.

FIG. 20A is an end view of a T-shaped anchoring clip with a serrated surface on its outstanding leg which is turned upwards and contains a slotted hole for a bolt.

FIG. 20B is an end view of a T-shaped anchoring clip with a serrated surface on its outstanding leg which is turned downward and contains a slotted hole for a bolt.

FIG. 21 is an end view of another embodiment of a mechanical anchoring clip with a hexagonal slot on its outstanding leg, shown by dotted lines, which receives an undercut anchor bolt and its other double hooking end snugly fits around a flange of a perimeter frame.

FIG. 22 is an end view of one embodiment of an edging clip which supports a small edge return on a wall panel.

FIG. 23 is an end view of another embodiment of an edging clip which supports a smaller edge return on a wall panel.

DETAILED DESCRIPTION OF THE INVENTION

The present invention is a very versatile and comprehensive wall system designed specifically for the thin reinforced natural stone panels and is comprised of a series of novel extruded aluminum shapes each of which will accomplish a different task to facilitate the installation of the exterior wall panels on buildings and simplify their methods of attachment to the building structure. These extruded aluminum shapes are divided into the following four categories: (1) perimeter frames, which are bonded to the thin stone panels and are shown on FIGS. 4, 8, 9, and 10; (2) attachment clips, which are shown on FIGS. 11 thru 16, are attached to the frames and serve to anchor the panels to a building substrate or to connect to another panel frame in the case of pre-assembly of panels; (3) anchoring clips, FIGS. 17 thru 21, are used to anchor the panels to the building substrate and are used as continuous runners or short clip sections; and (4) edge clips, FIGS. 22 and 23, which are used to create a self-edge on a panel to simulate a much thicker stone panel as may be found in more traditional stone construction. The present invention provides the means to pre-assemble in a shop various panel sections into various profile shapes for delivery to a jobsite and quick and easy installation on the building. This shop assembly method is very advantageous in that it significantly reduces the jobsite construction time thus saving both time and money to the project.

Figure 1:
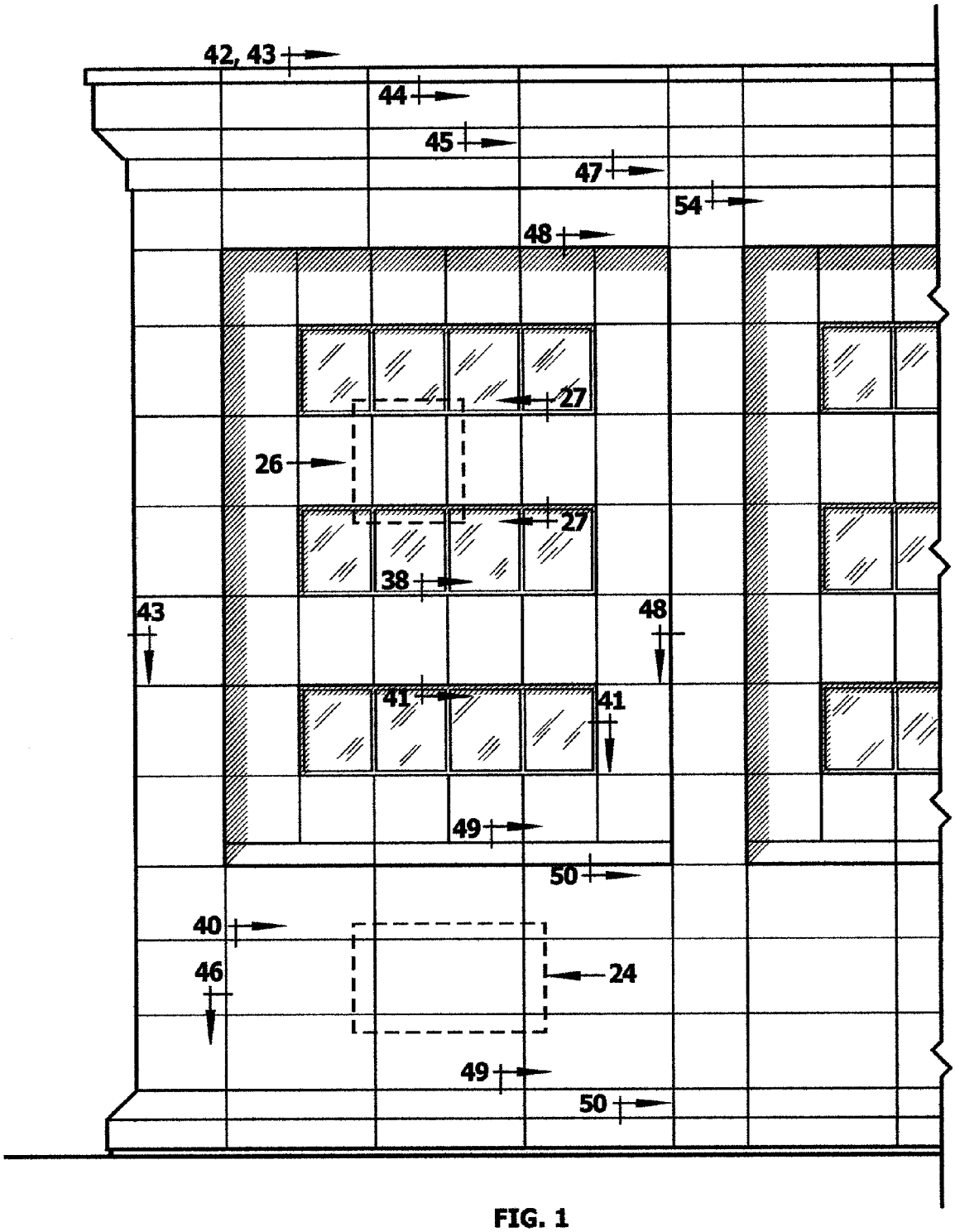
FIG. 1 is a partial front elevation view of a building schematically showing various details, profiles, and conditions on a building facade which are constructed using the present invention.

FIG. 1 illustrates a partial elevational view of a building schematically shown which incorporates a number of wall profile conditions which may be found in a building facade of natural stone. As opposed to a typical flat panel curtain wall, which the prior art RS300 system was designed to accommodate, the system according to the present invention provides for coverage of a wide variety of shapes and profiles which can be part of an architectural facade design. The following specific details illustrated in FIGS. 38 thru 50 and corresponding to the labeled arrows in FIG. 1 illustrate in detail that the present invention is a comprehensive wall system in which the various extruded aluminum shapes shown on FIGS. 4 thru 23 can be combined and utilized to produce the required profiles of this example.

The perimeter frame 100 (see FIG. 4) is the basic component of the wall system and performs multiple functions and has a number of purposes. Primarily it is bonded to the thin stone panel 101 on all sides, see FIGS. 6 and 7, and serves as an edge protector for the otherwise vulnerable edges and corners of the thin stone 101 without which it would be difficult to handle the panels safely. It provides the required structural support for the perimeter of the panels and also functions as an intermediate stiffener for the larger panel sizes. Its flanges 100*a* and 100*b* nest into the female sockets of the anchoring clips and runners to secure the panel to the building substrate. It provides the necessary depth in the pocket between panels in both planar and angled panel intersections to create a proper caulked joint consisting of a compressible backer rod 140*b* and the sealant 140*a* (see FIGS. 40 and 46). Compared to the prior art, the design of the basic perimeter frame 100 (FIG. 4) of the present invention is wider, deeper, and stronger than the frame 102 of the prior art RS300 system. The changes can be clearly observed by comparing the current design 100 shown in FIG. 4 with the prior art 102 as shown in FIG. 2. Because of these changes the Section Modulus of the newly designed basic frame 100 about the x-axis has increased by 87% and the Moment of Inertia has increased by 153%, changes which substantially increase the stiffness of the frame 100 and represent a significant improvement in structural performance of the present invention.

For purposes of description we consider the flat part 100*d* of the frame 100 which is in contact with the reinforced thin stone panel 101 to be the bottom 100*d* of the frame 100. Therefore the top of the frame is composed of two separately spaced flanges 100*a* and 100*b* one of which 100*a* is positioned to form a "flush edge" 100*h* at one side of the frame 100 and the other flange 100*b* on the opposite side is positioned or recessed from the edge of the frame 100 in such manner as to from a 45 degree angled edge 100*g* of the frame and this edge is called the "rebate edge" 100*g*. FIG. 6 illustrates the flush edge 10*h* of the frame 100 positioned even with the cut edge 101*b* of the stone panel 101 and this edge condition is commonly used when panels meet in the same plane as in a flat wall. This condition can be seen in FIG. 40 and FIG. 46. When the planes of panels meet at an angle the edge frame 100 is positioned differently on the stone panel 101 as shown in FIG. 7 so that the rebate edge 100*g* forms an angle edge 101*a* with the stone 101 which is also usually cut at a miter angle 101*a* which can vary according to the desired type of intersection of the panels. A variety of rebate edge conditions are shown in FIGS. 38, 41, 42, 45, and 48. Some of these edge conditions require slightly different placement of the frame 100 on the panel 101 and the frames must be positioned with precision. Once they are combined with the proper clip section, the desired joint condition is achieved automatically.

Both ends of each flange 100*c* of the basic frame 100 serve as male retainers when they nest into the female sockets of the various corner and angle clips and wall runners. This feature is illustrated in FIGS. 38 and 40 thru 54. Just below the outward ends of the flanges 100*c* the design of the extrusion creates a female socket 106 which will mate with the male hooks of the various attachment clips to perform various tasks and form the desired profiles. These features greatly simplify the process of panel installation on a building substrate enabling the installation to proceed at a much faster rate then could be obtained in conventional stone construction.

In the two opposite lower outside corners of the frame 100 as shown in FIG. 4 there is a recess 107 to accept the two beads of structural silicone adhesive 103 which are shown in FIGS. 6 and 7 and which bond the aluminum frame 100 to the thin reinforced stone panel 101. These two beads of silicone 103 provide a double sealant bite of adhesive attachment. While a single bite would be structurally adequate in most cases, the double bite provides additional security. The double bite of adhesive is also very advantageous in that it reduces the torque or cleavage effect caused by negative wind pressure which would tend to pull the panel 101 away from the frame 100. The use of intermediate stiffeners (see FIGS. 24 and 25) in a typical fascia panel serves to reduce the area of the panel to be structurally supported by the silicone and to provide resistance to positive and negative live loads. The design criteria for the use of structural silicone in the glazing and curtain wall industry has been established by the manufacturer, Dow Corning and others, and is a function of the area of silicone bite, or contact, in relation to the area of panel being supported. The continuous double beads 103 of silicone adhesive around the perimeter of the panel 100 together with the double beads 103 of the stiffeners serve to divide the panel into smaller areas of four-sided silicone attachment. The result is a substantial structural over-design. This four-sided attachment method is similar to the method of attachment of glass facades on buildings by means of structural silicone glazing which has been in use for over forty years. The methods of silicone attachment 119*a* with the hooks upturned 119*c* when attached to the building substrate. The same clip (FIG. 19B) is used as a panel clip 119*b* with the hooks down-turned 119*d* when attached to the vertical frames of a panel. This clip mates with itself and is used as a self-nesting anchoring clip as seen in FIGS. 26, 28, 39, 55 and 56. It is designed to work in conjunction with the adjustable runner 117 in that both anchoring clips position the panel frames equidistant from the substrate so they can be used on the same wall section and even on the same panel.

The stone panels 101 are precisely cut to required dimensions with proper edge finishing according to the particular detail requirement. The extruded aluminum frames 100 are accurately cut and positioned on the stone panels 101 according to precise measurements determined by the particular function of the frame 100 and the geometry of the particular attachment clip to be utilized to create the type of joint and intersection between panels which is required. In a flush edge condition 100*h* (see FIG. 6) the frame 100 is set even with the straight cut edge of the panel 101*b*. In a rebated edge condition 100*g* (see FIG. 7) used for a corner or angle intersection of two panels, the frame 100 is set back from the beveled or mitered edge 101*a* of the panel 100 by a pre-determined dimension which can vary according to the desired angle or function. The setback dimension is determined by the geometry of the intersection and the type of edge and joint desired and is dimensionally controlled by mechanical jigs attached to the panel.

Once the beads of silicone 103 have been applied they must remain absolutely static for at least twenty four hours in order for the silicone to cure properly. Any movement in the bead during this period could interrupt the curing process and weaken the bond. In the prior RS300 system this requirement caused a costly production bottleneck in the panel assembly process as the newly siliconed panels had to be left unmoved on an assembly table for twenty four hours prior to handling for storage or crating.

This problem is overcome in the teachings of the present invention because the aluminum frames 100 are fixed in place prior to application of the silicone 103 by means of a special high-strength double-faced industrial tape 104 manufactured by the Norton Co, and composed of a high density, closed cell polyurethane foam substrate with a high performance acrylic adhesive on both sides. The thickness of the tape 104 is only 0.020" (0.6 mm). Once the frame, with tape 104 applied to the flat bottom of the frame 100*d*, comes into contact with the panel 101*c* it cannot be moved. Therefore the positioning must be controlled with precision using mechanical adjustable jigs which position the frames 100 correctly on the panels 101. The positioning of the frames 100 will vary and is determined by the desired function of the frame, the type of joint required, and the particular geometry created by the attachment or anchoring clip to be utilized. This procedure securely fixes the frame 100 in place on the stone panel 101 so that the assembled panel 101 can be moved about after the silicone 103 has been freshly applied without interfering with the curing process. This procedure greatly increases the efficiency of the panel assembly process and lowers the cost of production.

The external shape of the basic perimeter frame 100 (FIG. 4) is designed to accommodate various structural requirements and functions. The two top flanges, 100*a* and 100*b*, the external female sockets 106 just below the flanges 100*c*, the recess pockets 107 at both lower outside corners, and the flat underside 100*d* of the frame all have their functions as has been previously discussed. So too does the internal space of the frame 100*f* have its functions. The dash line shape 105*a* and 105*b* shown in FIG. 6 represents one of the extended legs 105*a* or 105*b* of the splice connector 105 (FIG. 5) which can also be seen in FIGS. 30, 31, 33, and 34. This leg 105*a* or 105*b* of the splice-connector 105, when inserted into the internal space 100*f* of the perimeter frame 100 as shown, is constrained in the two internal female sockets 100*e* formed by the designed shape of the frame 100 and serves to provide a stable structural connection at the intersection of the two perimeter frames. The same type of connection can be obtained using slightly narrower versions of the splice connector 105 when working with the modified versions of the perimeter frame 108 and 109 shown in FIGS.

8 and 9. The extruded length of the splice-connector 105 is simply cut to the required width.

Figure 33:
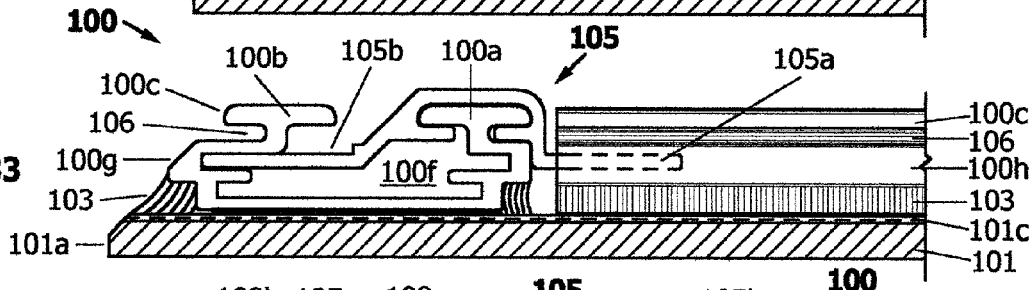
FIG. 33 is an embodiment of the view shown in FIG. 31 when the perimeter frame is reversed to position the rebate edge of the frame at the edge of the panel and the splice-connector clip is also reversed to surround the flange of the flush edge.
Figure 34:
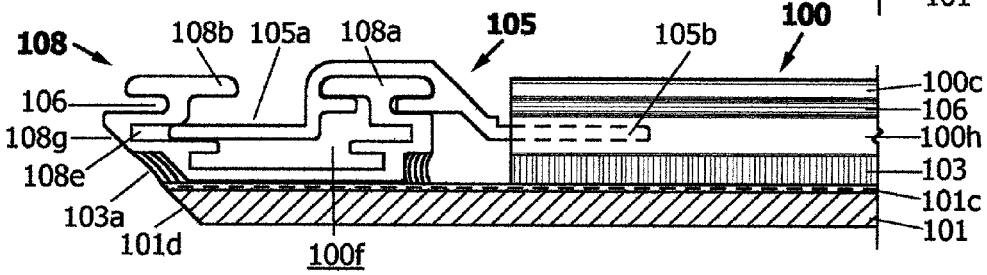
FIG. 34 is another embodiment of the view shown in FIG. 31 showing a different version of the perimeter frame which is an undercut shape used to support inside corner intersections of panels.

FIG. 5 illustrates the splice-connector clip 105 a novel clip whose function is to provide structural continuity between the two perimeter frames 100 intersecting at right angles while allowing some movement along the axes of both frames 100 by means of slip connections to compensate for possible external stress factors due to temperature differential, high windloads, or seismic forces. The two extended legs 105*a* and 105*b* of the clip 105 penetrate the internal spaces 100*f* of the frames 100 on each of the two intersecting panels as illustrated in FIGS. 30, 31, 33, and 34 and are locked firmly in position by the internal female sockets 10*e* in each frame. FIG. 6 illustrates, by use of the dotted line shape 105*a* or 105*b* the geometry by which the legs 105*a* or 105*b* of the splice clip is locked into position within the interior space 100*f* of one of the frames 100 while FIGS. 31, 33, and 34 illustrate the locking method in the other frame. The inner cavity 105*c* of the elevated mid-section of the splice clip 105 envelops one of the flanges 100*a* or 100*b* of a perimeter frame 100 and locks the splice clip 105 in position. The designed geometry of the splice clip 105 is universal in that it accommodates the different possible configurations on the various frames as illustrated in FIGS. 31, 33, and 34. One leg 105*e* descends from the mid-section at an angle to accommodate the rebate edge 100*g* of the frame 100 and just before intersecting with the horizontal leg 105*b* it turns horizontally and the vertically to create a small vertical wall 105*f* which is perpendicular to the leg 105*b*. The purpose of this small vertical wall 105*f* is to prevent the frame 100 from being pressed tightly against the angled leg 105*e* and becoming wedged in a locked position. The other leg 105*d* descends in a vertical direction to accommodate the flush edge 100*h* of the frame 100. Prior to assembly the clips 105 are slid onto the flange 100*a* or 105*b* of the relevant frame 100 and once in assembled position they will allow some movement in the plane of the panel in both of the intersecting frames parallel to their axes. There are no fixed connections, only slip connections. The splice clip 105 will function in a similar manner as described above with two other frames 108 and 109 by simply cutting the clip to a narrower dimension to fit the inner space of the frames.

Figure 8:
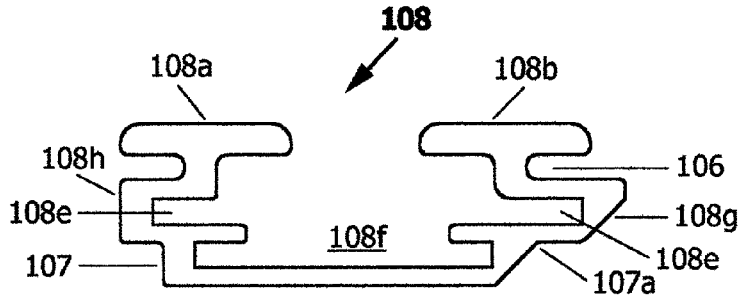
FIG. 8 is an end view of another embodiment of a perimeter panel frame having an undercut bias.
Figure 49:
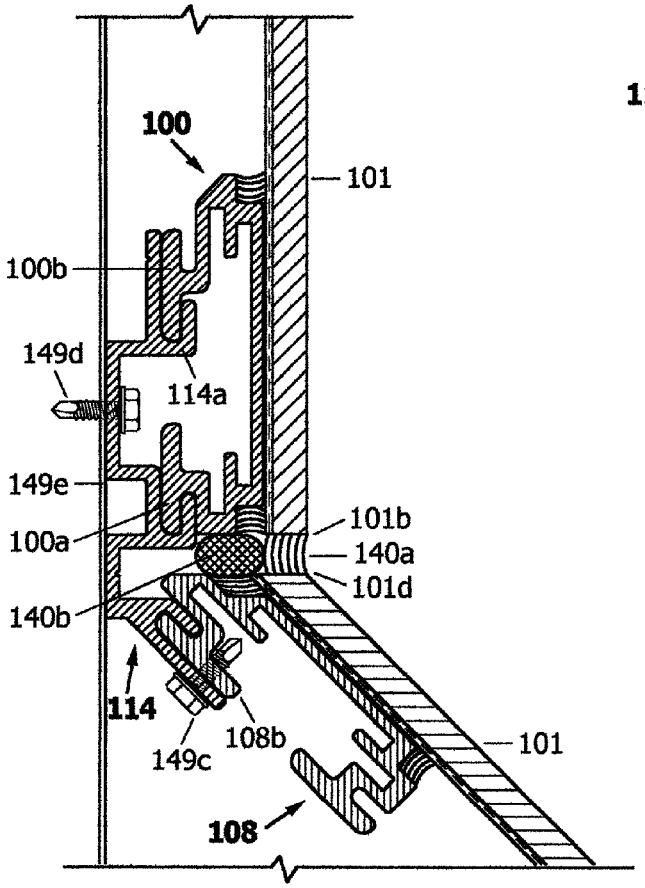
FIG. 49 is a detailed cross-sectional view taken at the location indicated by labeled arrowed lines on FIG. 1 which shows an inside corner intersection between two panels where an attachment clip is pre-attached to the lower panel and serves to anchor the lower panel to the structure and receives and supports the upper panel and automatically creates a pocket for a caulked joint.

FIG. 8 illustrates an undercut perimeter frame 108 which is a modified variation of the basic perimeter frame 100 and is used to support the intersection of two panels which meet at an inside angle of 135 degrees. The basic functions of the perimeter frame 108 are similar to those of the basic frame 100 which has been previously described. The biased edge 108*g* and recess 107*a* for the silicone bead 103 provide the undercut shape which allows the inside angle intersection as illustrated in FIG. 49. The design of the interior space 108*f* of the frame 108 provides the female sockets 108*e* which receive and lock into position the extended leg 105*a* of the splice-connector clip 105 as can be seen in FIG. 34. The splice-connector envelops the flange 108*a* of the frame 108 while the other flange 108*b* is available for screw attachment to the attachment clip 114 as shown in FIG. 49.

Figure 9:
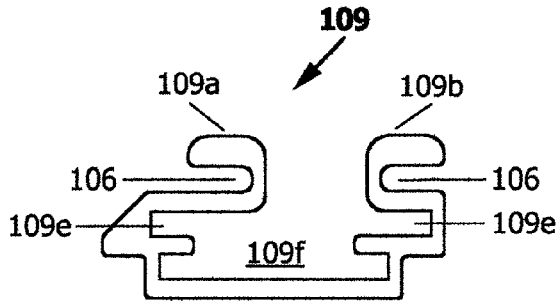
FIG. 9 is an end view of another embodiment of a smaller perimeter panel frame than the one shown in FIG. 4.

FIG. 9 illustrates a smaller version 109 of the basic perimeter frame 100 and is useful on smaller panels which do not require the full strength and dimension of the basic frame but its general functions are similar to the basic frame 100. The upper flanges 109*a* and 109*b* function to nest with the female sockets of the attachment clips and anchoring clips. Just below the flanges 109*a,b* are the female sockets 106 which receive the hooks of the attachment clips. The interior space 109*f* provides two female sockets 109*e* which can receive and lock in position a splice-connector clip 105 which can be utilized in an intersection of the smaller frame 109 with the basic frame 100. In this case the splice-connector clip 105 is cut to a narrower width than that shown in FIG. 30 in order to accommodate the smaller frame 109.

Figure 10:
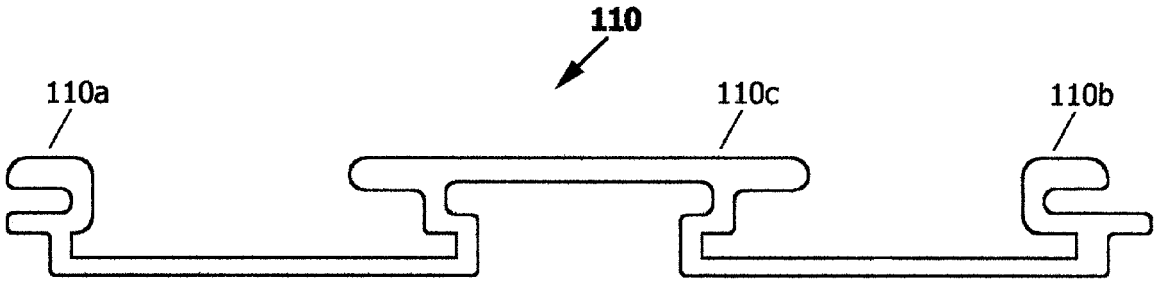
FIG. 10 is an end view of one embodiment of a panel frame which creates a return section for attachment to another frame.
Figure 39:
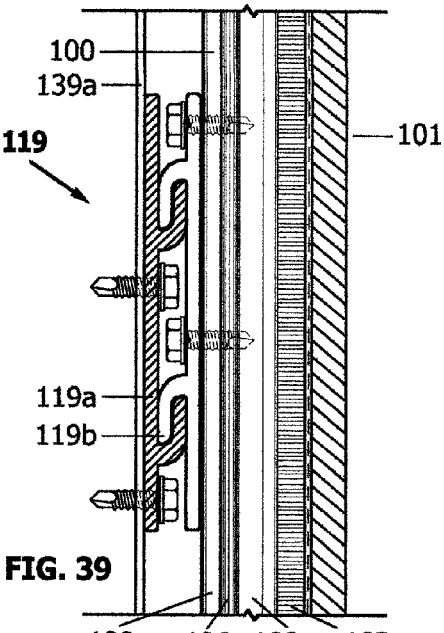
FIG. 39 is a detailed cross-sectional view taken at the location indicated by labeled arrowed lines 39—39 on FIG. 26 and which shows a pair of mating double hook anchoring clips connecting the frame of a fascia panel to the building substrate.
Figure 48:
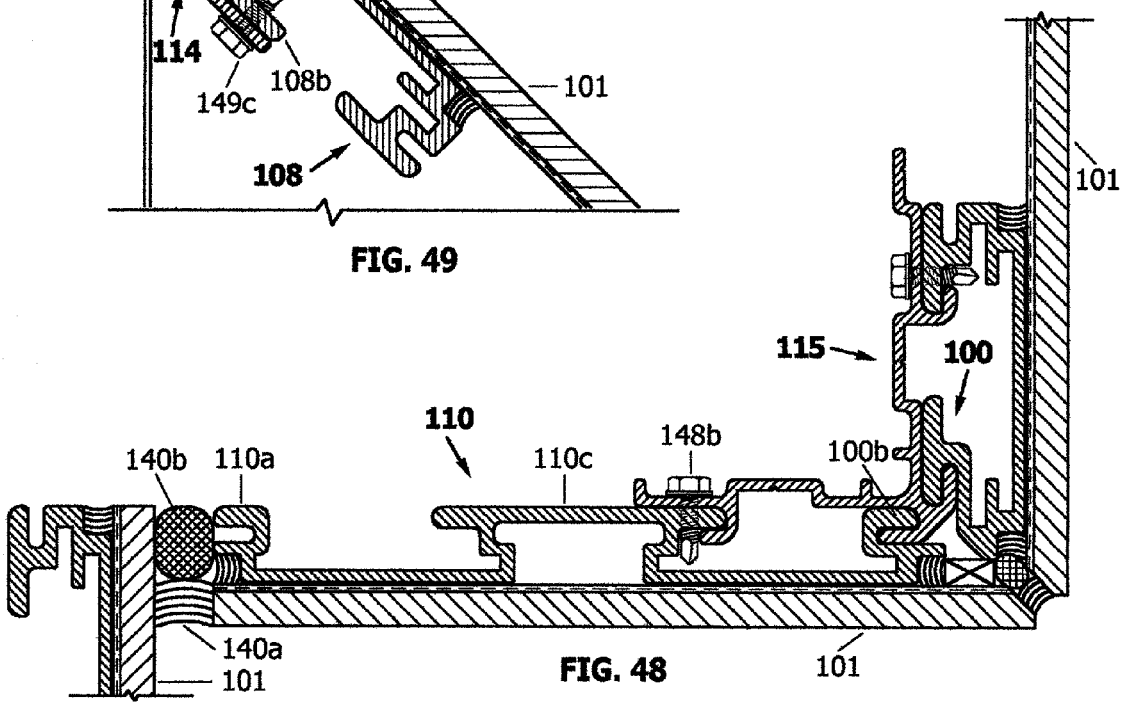
FIG. 48 is a detailed cross-sectional view taken at the location indicated by labeled arrowed lines on FIG. 1 which shows a larger return pre-assembled to a fascia panel with a quirk miter caulked joint at the corner intersection and a typical caulked joint where the return abuts a wall panel.

FIG. 10 illustrates a larger frame 110 which is utilized primarily for pre-assembly when a return of 8" is required on a fascia panel. This frame 110 is not as deep as the other frames 100, 108, 109 and that is in order to reduce the amount of space required for its installation which is sometimes limited. The rebate edge flange 110*b* will nest with the various corner angle attachments and the flush edge flange 110*a* will provide a pocket deep enough to contain the backer rod 140*b* and caulking 140*a* as required. The larger central flange 110*c* serves to accept screw attachment to a corner angle clip as can be seen in FIG. 48 and also can serve as a platform for an anchor clip 119 as illustrated in FIG. 39

FIGS. 11 thru 16 illustrate various attachment clips which are used to control an angle intersection between panels. In addition to controlling the panel intersection, these clips will perform various other functions. They will usually be attached to one of the intersecting panel frames by screws and then attached by screw to the building substrate thus fixing the panel in place on the building ready to receive the adjoining panel into its female sockets. In a panel pre-assembly they will be attached to both intersecting panels. An important function of these attachment clips is the automatic positioning of the intersecting panels which provides the space and pocket for the backer rod 140*b* and caulking material 140*a* and to produce a correct joint between panels which is uniform and esthetically pleasing.

Figure 11:
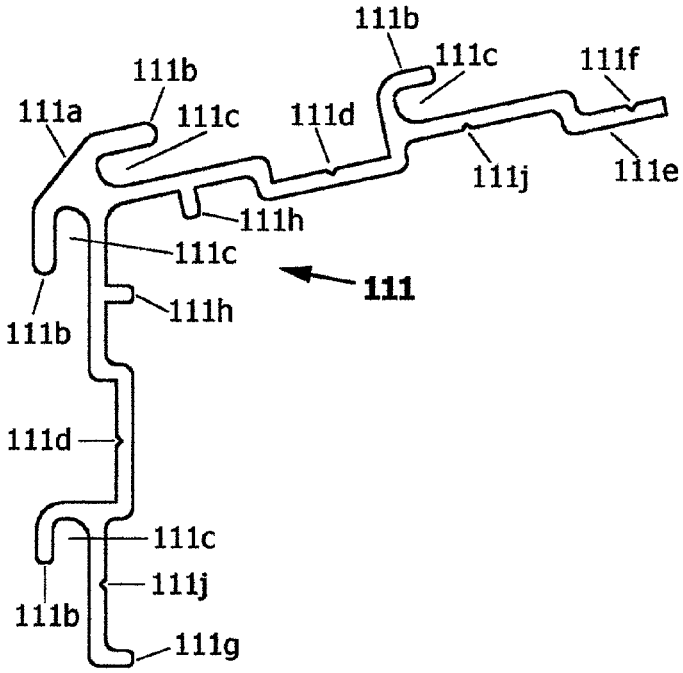
FIG. 11 is an end view of an embodiment of a connector clip which supports an angled intersection of two panels to form an outside corner which deviates from an orthogonal relationship to form, for example, a corner.
Figures 42, 43, 44:
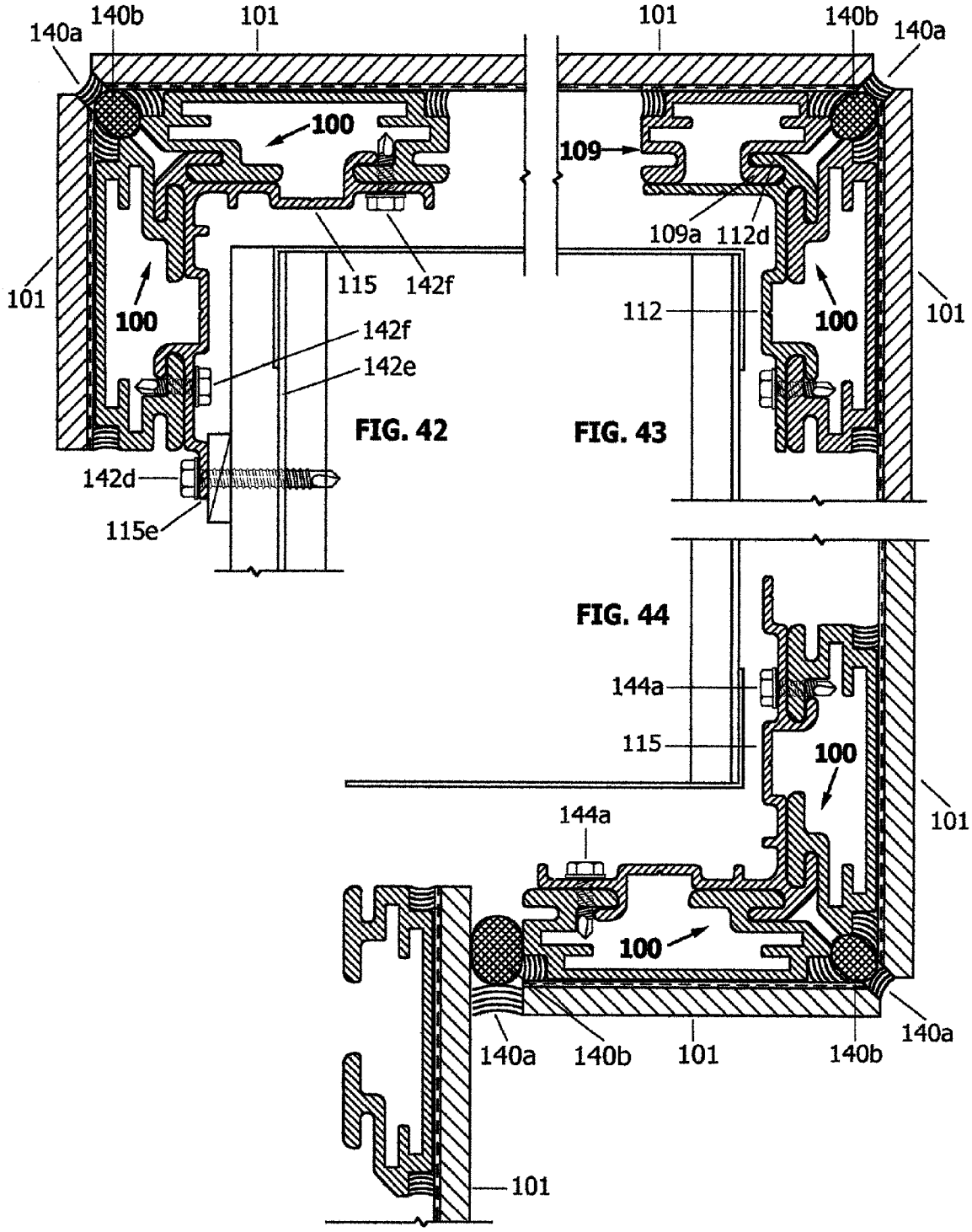
FIG. 42 is a detailed cross-sectional view taken at the location indicated by labeled arrowed lines on FIG. 1 and showing a pre-assembled return on a coping panel at the roof-top of a wall with the connecting clip of the two panels providing the anchorage to the building structure.
FIG. 43 is a detailed cross-sectional view taken at the location indicated by labeled arrowed lines on FIG. 1 and showing how the coping panel connects to the fascia panel and creates an automatic quirk miter joint at the orthogonal intersection of the panels.
FIG. 44 is a detailed cross-sectional view taken at the location indicated by labeled arrowed lines on FIG. 1 showing a return section which has been pre-assembled to a fascia panel with a quirk miter caulked joint and the return abuts another fascia panel leaving space for a caulked joint.

FIG. 11 illustrates an attachment clip 111 designed to support two intersecting panels at an outside angle of 258 degrees (inside angle of 102 degrees). For description purposes reference will be made to the outside of the angle and the inside of the angle. Starting from the intersection of the two legs of the angle 111*a*, on the outside can be seen two hook shapes 111*b* on each leg creating female sockets 111*c* which will nest with the two flanges 100*a* and 100*b* of each perimeter frame 100 on the intersecting panels (refer to FIG. 38). Between the hooks 111*b* can be seen a recessed section containing a V-shaped screw guide 111*d*. This is used to locate the screw when it is desired to attach the clip 111 to a building substrate. The recess 111*d* provides space for the screw head so that it will not interfere with placement of the panel frame flanges 100*a* or 100*b*. The endings of the two legs are different. One has an outward extension 111*e* which is also recessed and contains a V-shaped screw guide 111*f*. This extension 111*e* is utilized when it is desired to attach a pre-assembled panel to a substrate as illustrated in FIG. 42. The ending of the other leg has a short turned up section 111*g* which can provide some stability to prevent rocking when the clip 111 is attached to a substrate. The two small protrusions 111*h* near the center intersection on the inside of the angle are for the same purpose, to provide stability. Opposite the outermost hook 111*b* on both legs can be seen a V-shaped screw guide 111*j* on the inside of the clip 111 and this is to locate the screw to attach the clip 111 to the panel flange 100*a* or 100*b* in the event of pre-assembly.

Figure 12:
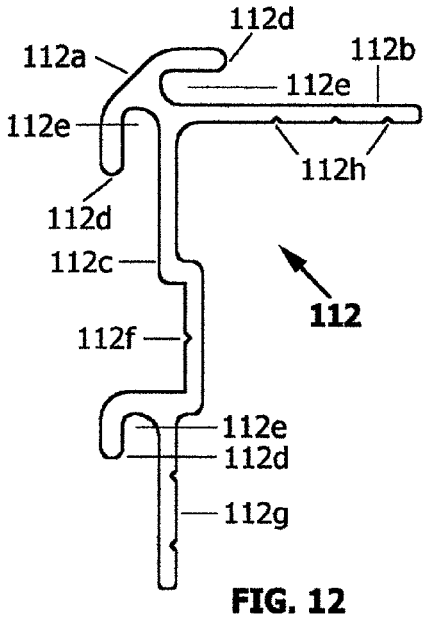
FIG. 12 is an end view of another embodiment of a connector clip which supports an angled intersection of two panels to form an outer corner of 270 degrees.
Figure 53:
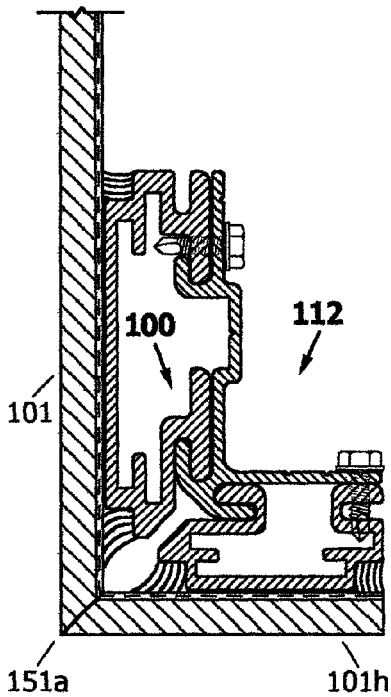
FIG. 53 is a detailed cross-sectional view which shows a method to create a 3" panel edge return with a full miter joint and which will simulate a 3" slab thickness

FIG. 12 illustrates an attachment angle clip 112 designed to support two intersecting panels at an outside angle of 270 degrees and an inside angle of 90 degrees. FIGS. 43 and 53 illustrate two different uses of this attachment clip 112. Starting at the intersection of the two legs of the angle 112*a*, one leg 112*b* is extended in a flat or straight form and the other leg 112*c* contains two hook shapes 112*d* creating two female sockets 112*e* which will nest with the two flanges

100*a* and 100*b* of a perimeter frame 100. The recessed portion 112*f* between the hooks 112*d* provides a space 112*f* for screw attachment to a substrate. The extended leg 112*g* beyond the second hook contains screw guides to correctly position the screw attachment to the flange 100*a* of a frame 100 in a pre-assembly. The other leg of the angle 112*b* has only one hook 112*d* creating one female socket 112*e* which will nest with the flange 109*a* of the small perimeter frame 109 as well as the flange 100*b* of the basic perimeter frame 100 and the extended flat leg 112*b* can be utilized either as a simple support for either frame 109 or frame 100 or as a means of pre-assembly by screw attachment using screw guides 112*h* for correctly positioning the screws to make proper contact with the flanges of the frames.

Figure 13:
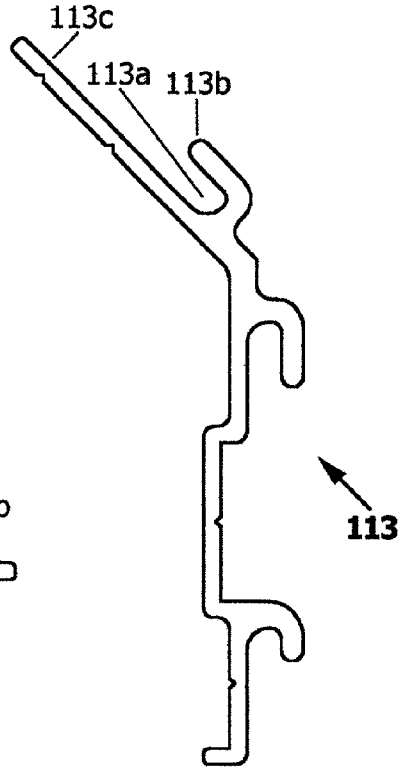
FIG. 13 is an end view of another embodiment of a connector clip which supports an angled intersection of two panels to provide an outside corner of 225 degrees.
Figure 47:
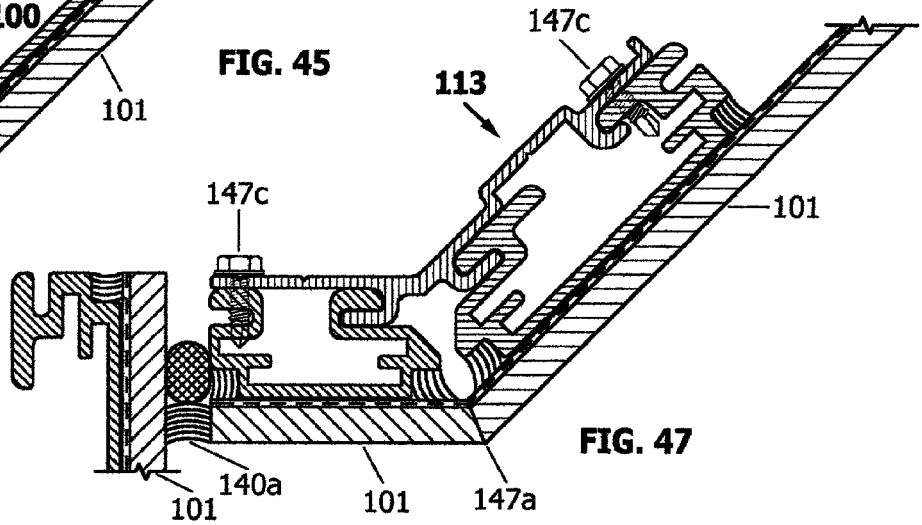
FIG. 47 is a detailed cross-sectional view taken at the location indicated by labeled arrowed lines on FIG. 1 which shows a small return pre-assembled to a sloping fascia panel with a full miter joint and which abuts another vertical fascia panel leaving space for a caulked joint.
Figure 50:
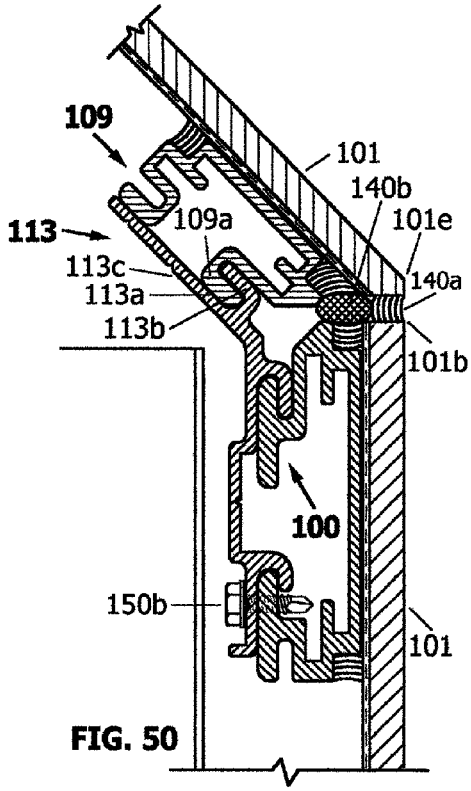
FIG. 50 is a detailed cross-sectional view taken at the location indicated by labeled arrowed lines on FIG. 1 which shows an outside angled corner intersection between two panels where an attachment clip is pre-assembled on the lower panel and serves to support the upper panel and automatically creates a pocket for the caulked joint.

FIG. 13 illustrates an attachment angle clip 113 which supports two intersecting panels at an outside angle of 225 degrees and an inside angle of 135 degrees. This clip 113 is similar to the clip 112 described above except that the angle of intersection is different. The basic functions are similar. FIGS. 47 and 50 illustrate different methods of use for this clip 113. It will be apparent to one skilled in the art that variations in the angle of intersection of panels other that those shown in this application can be easily obtained by changing the angle of the legs of an attachment clip, a change which falls within the scope of the present invention.

FIG. 14 illustrates an attachment angle clip 114 which supports two intersecting panels at an inside angle of 135 degrees. This clip is designed to support the intersection of the undercut frame 108 with the basic perimeter frame 100 as illustrated by FIG. 49. It can also be utilized in various ways as an anchor attachment to a substrate and as a pre-assembly clip to either one of the frames 100 or 108. The flanges 100*a,b* of the basic perimeter frame 100 will nest into the female sockets 114*a* formed by the hooks 114*b*. The deep recess 114*e* between the two hooks 114*b* provides space for a screw attachment 114*e* to a substrate. When the flanges 100*a,b* are nested with the sockets 114*a*, the geometry of this clip 114 will position the frames 100 at a distance from the substrate which is consistent with that provided by the other anchoring clips 117 and 119 so all the clips can be utilized together on the same panels and planar wall sections. The flange 108*a* of the undercut frame 108 will nest into the female socket 114*d* formed by the hook 114*c*. The screw guide 114*f* provides correct placement of the screw for pre-assembly. When both panel frames, 100 and 108, are properly assembled with this clip 114, a pocket is automatically created for a backer rod 140*b* and a sealant 140*a* to form a proper caulked joint.

FIG. 15 illustrates an attachment angle clip 115 which supports the intersection of two panels at an outside angle of 270 degrees and an inside angle of 90 degrees. This clip 115 is very similar, except for the angle of intersection, to the clip 111 shown and described in detail under FIG. 11 and the same comments can apply to this clip 115. This clip 115 will probably be the most frequently used angle clip because it supports the basic orthogonal intersection of panels. Some of its many uses are illustrated by FIGS. 41, 42, 44, 48, and 54.

Figure 45:
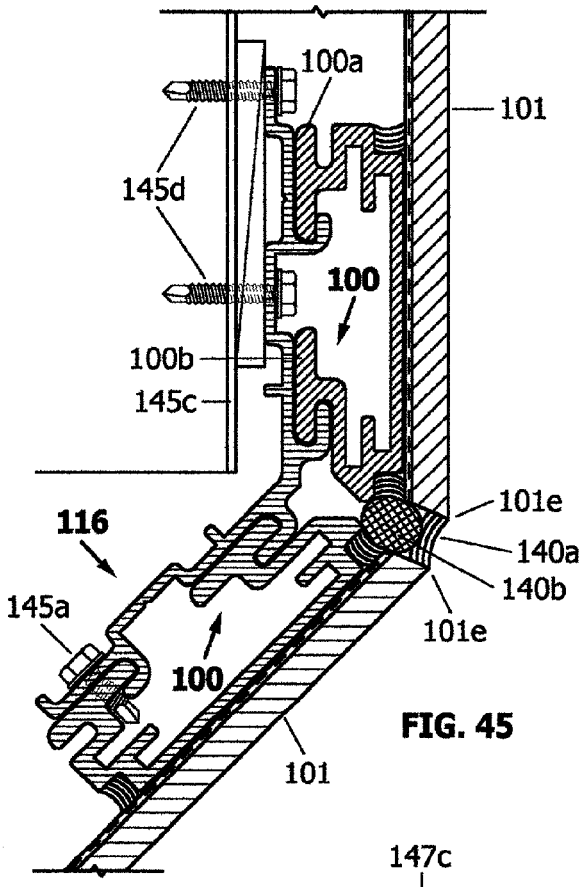
FIG. 45 is a detailed cross-sectional view taken at the location indicated by labeled arrowed lines on FIG. 1 which shows an angled intersection of two panels where the lower panel has a pre-mounted attachment clip which is anchored to the structure and supports the upper panel.

FIG. 15*a* illustrates the prior art clip 15*a* which is an earlier version of clip 115. The improved version of the present invention 115 is a more developed profile and more versatile and adaptable to structural attachment to a substrate. This can be seen in the longer extended leg 115*e* which has two possible locations for screw attachment to a substrate, 115*f*, and 115*d*. The smaller protrusions 115*h* near the center intersection and at the end of the shorter leg 115*g* provide more stability against rocking movement when the clip is attached to a substrate. The screw guides 115*j* indicate the proper point for screw attachment to a perimeter frame 100 in the case of pre-assembly of two panel sections FIG. 16 illustrates an attachment angle clip 116 designed to support the intersection of two panels at an outside angle of 225 degrees and an inside angle of 135 degrees. FIG. 45 illustrates one use of this clip 116 where it is pre-attached to a lower panel and then the clip 116 is anchored to a substrate by screws 145*d* and then serves to receive the flanges 100*a,b* of an upper panel. The features of this clip 116 are similar to the clip 111 described in detail under FIG. 11. The angle of intersecting panels is similar to that of clip 113 shown in FIG. 13 but this clip 116 offers greater latitude of use in terms of pre-assembly and anchorage attachment to the substrate. The screw guide points 116*f* on the extended leg 116*e* and at 116*d* provide dual attachment points to a building substrate as illustrated in FIG. 45. The screw guides 116*j* indicate the proper point for screw attachment to the flanges 100*a* and 100*b* of a perimeter frame 100. The small protrusions 116*g* and 116*h* serve to add stability in the event of contact and attachment to a building substrate.

Figure 40:
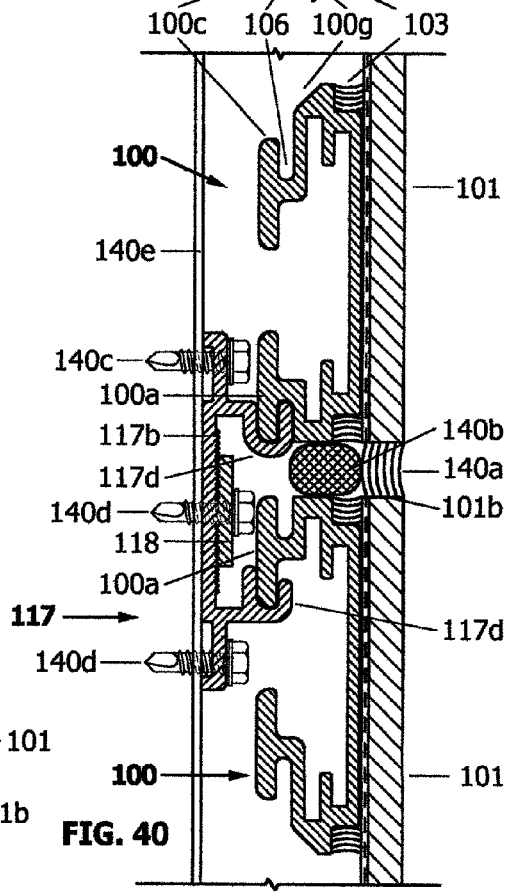
FIG. 40 is a detail cross-sectional view of an adjustable horizontal runner clip which hooks and supports the top frame of a lower fascia panel and the bottom frame of an upper fascia panel and automatically creates the correct size horizontal joint between panels.

FIG. 17 illustrates an adjustable horizontal runner 117 which is attached to the building substrate with screws and receives and supports the panels as shown in FIG. 40. It has a vertically slotted hole 117*a* for a screw in a horizontally serrated inner surface 117*b* and is used in conjunction with the serrated 118*a* square washer 118 shown in FIG. 18 to allow adjustability up or down. This is a very useful feature in a field installation to assist the installer to locate the correct position of the runner. The meshing of the serrated surfaces 171*b* and 118*a* serves to lock the runner and washer firmly together when the center screw is tightened. Loosening the screw allows the runner to be moved up or down without releasing it. The female sockets 117*c* created by the two upturned hooks 117*d* serve to capture and support the outer flanges 100*a* and 100*b* of upper and lower planar panels in the correct positions to create the pocket for a caulked joint between panels (refer to FIG. 40).

FIG. 19A illustrates a double hook anchoring clip 119*a* which is used as a continuous runner 119*a* with the hooks upturned 119*c* when attached to the building substrate. The same clip (FIG. 19B) is used as a panel clip 119*b* with the hooks down-turned 119*d* when attached to the vertical frames of a panel. This clip mates with itself and is used as a self-nesting anchoring clip as seen in FIGS. 26, 28, 39, 55 and 56. It is designed to work in conjunction with the adjustable runner 117 in that both anchoring clips position the panel frames equidistant from the substrate so they can be used on the same wall section and even on the same panel.

Figure 55:
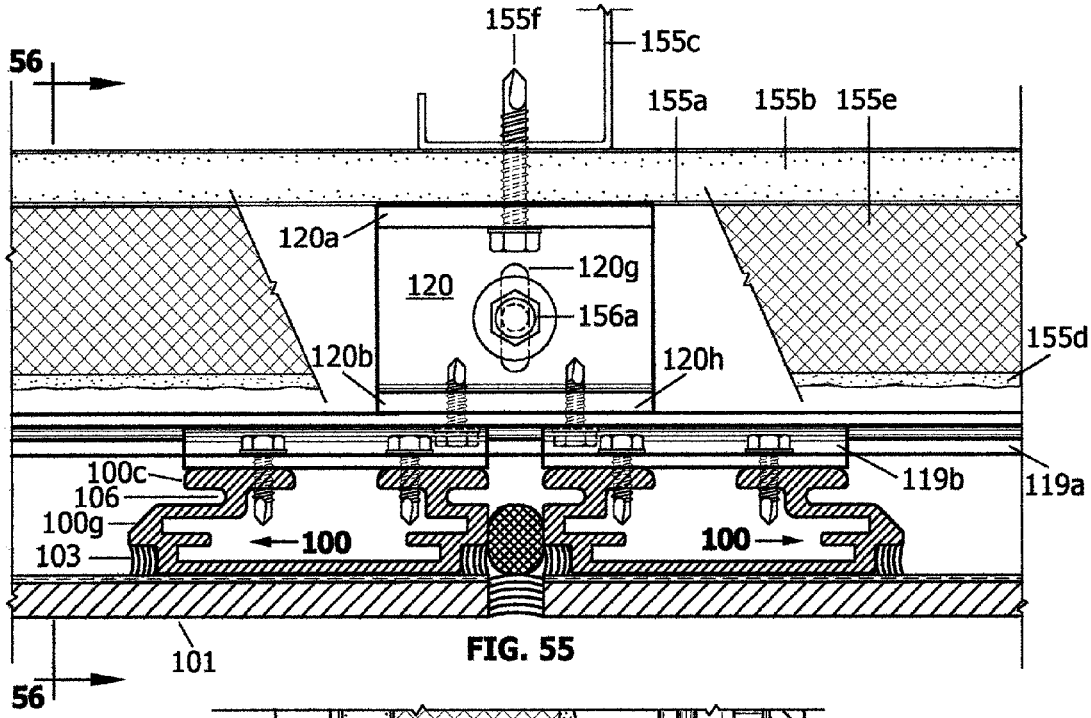
FIG. 55 is a detailed horizontal cross-sectional view taken at lines 55—55 on FIG. 56 of an assemblage of panel frames and anchoring clips which utilize adjustable T-clips to position the panels some distance from the building structure.
Figure 56:
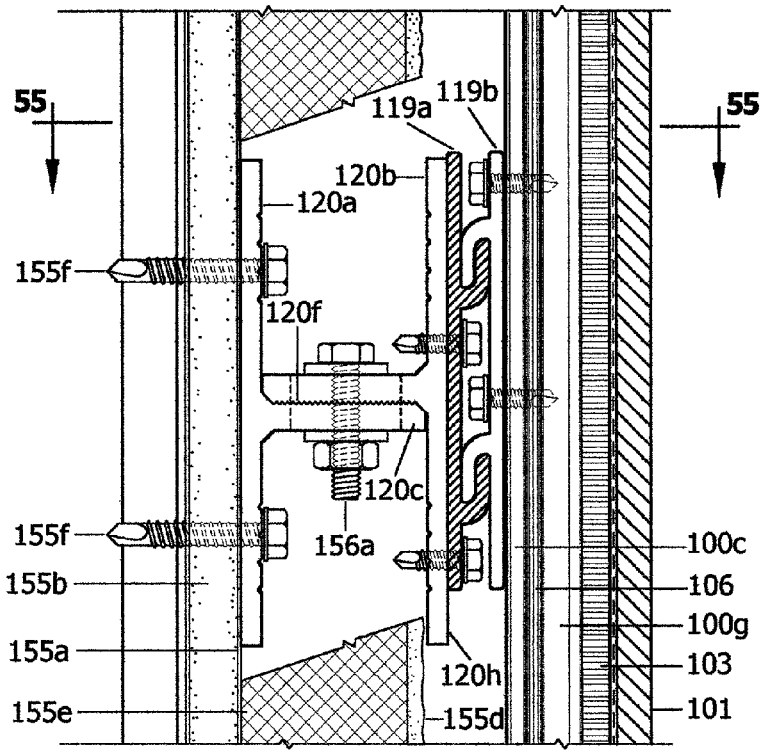
FIG. 56 is a detailed vertical cross-sectional view taken at lines 56—56 on FIG. 55 of a assemblage of panel frames and anchoring clips which utilize adjustable T-clips to position the panels some distance from the building structure.

FIGS. 20A and 20B illustrate a pair of T-shaped anchoring clips 120*a* and 120*b* which are the same clip only with different functions. One clip 120*a* is shown with a serrated face 120*f* on the up-turned side of its shorter outstanding leg 120*c* which also has a slotted hole 120*g* as shown by the dotted lines. This clip 120*a* mates with the T-shaped anchoring clip 120*b* and the two serrated surfaces 120*f* serve to lock the clips 120*a* and 120*b* in the desired position when they are tightly joined by bolts and washers as shown in FIGS. 55 and 56. The slotted holes 120*g* in the two nested clips allow for in/out adjustability. The inside vertical faces of the clips contain multiple screw guides 120*d* as a convenience for the installer to guide the drilling of screw holes. The T-clips 120*a* and 120*b* can be utilized when it is necessary to position the panel some additional distance from the substrate than provided by details in FIGS. 39 and 40. The outside face of the outer clip 120*h* provides a vertical surface for the mounting of a runner clip, either 117 or 119. The T-clips can be used either in a horizontal position (as shown) or in a vertical position depending on the circumstances of the substrate.

Figure 35:
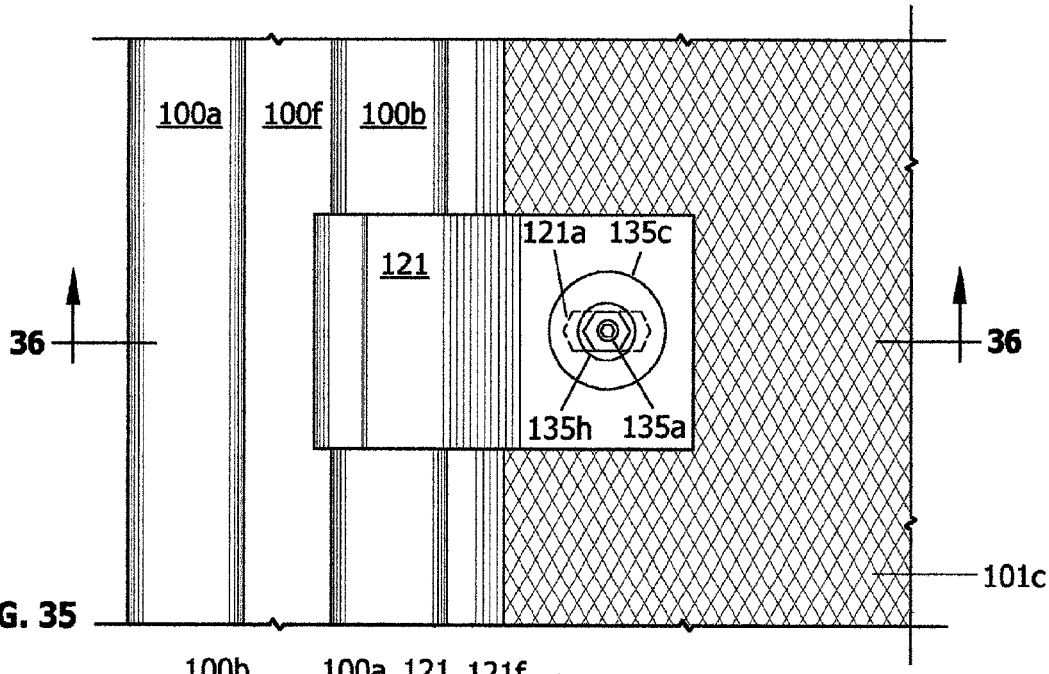
FIG. 35 is a detail plan view showing the mechanical anchoring clip which locks together the panel frame and the panel by means of an undercut expansion bolt.
Figure 36:
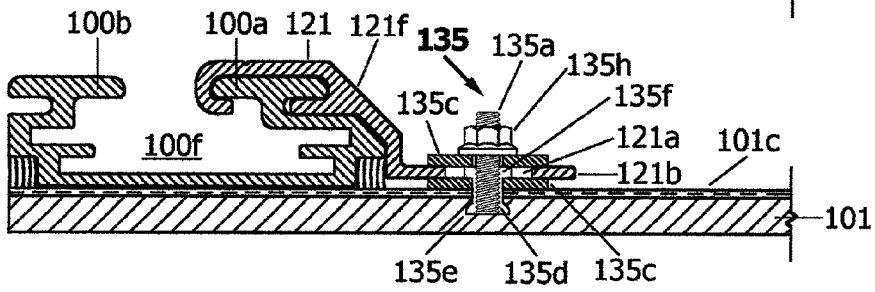
FIG. 36 is a cross-sectional view taken on line 36—36 of FIG. 35 showing the mechanical anchoring clip locking together the panel frame and the panel by means of the undercut expansion bolt.

FIG. 21 illustrates a novel anchor clip 121 used in the mechanical anchorage of the stone panel 101 to the extruded aluminum panel frame 100 as shown in FIGS. 35 and 36. This clip 121 provides a structural connection between the panel 101 and the aluminum frames 100 and 108 and is designed to work with the undercut expansion bolt 135 as described under FIGS. 35 and 36 in order to secure the mechanical connection between the stone panel 101 and the building structure by connecting the stone panel to the perimeter frame 100 which is, in turn, connected to the building structure. It has a slotted hole 121*a* on its extended leg 121*b*, as shown by dotted lines, through which the expansion bolt is inserted. The slotted hole allows some adjustability in locating the hole drilled in the back of the panel 101. The inner cavity 121*c* envelops one of the flanges 100*a* or 100*b* of the perimeter frame 100 or the flange 108*a* of the undercut frame 108 and locks the clip 121 in position on the frames 100 and 108. One of the enveloping legs 121*d* of the cavity 121*c* fills the female socket 106 of the flange 100*b* of the frame 100 and the other leg 121*e* curls around the other edge 100*c* of the frame 100 and this is illustrated in FIG. 36. The descending leg of the clip 121*f* would perform its function equally well if it were mounted on the flush edge 100*h* of the frame 100 instead of the rebate edge 100*g* as shown.

Figure 51:
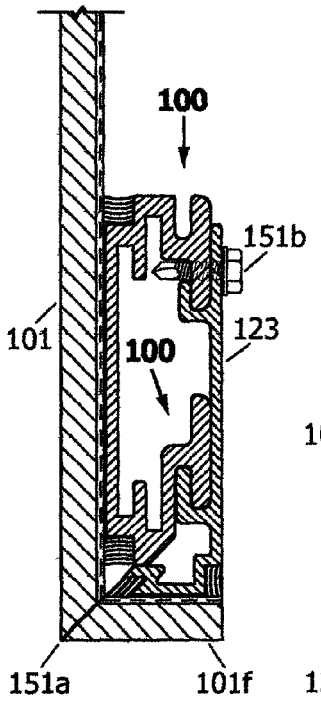
FIG. 51 is a detailed cross-sectional view which shows a method to create a 1½" panel edge returrn with a full miter joint and which will simulate a 1½" thick slab.
Figure 52:
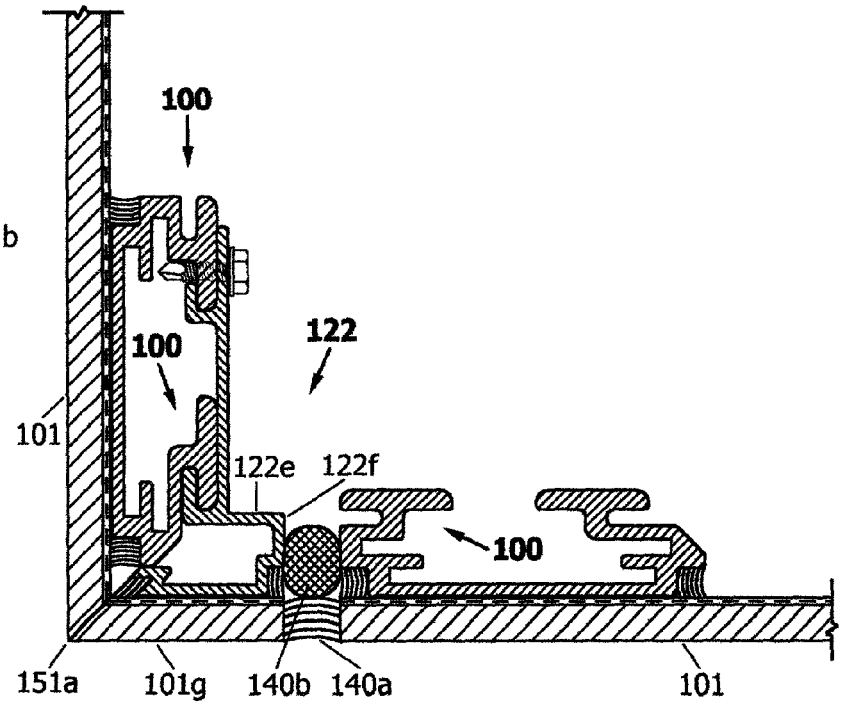
FIG. 52 is a detailed cross-sectional view which shows a method to create a 2" panel edge return with a full miter joint and which will simulate a 2" slab thickness and shown abutting another panel with a caulked joint at the intersection.
Figure 54:
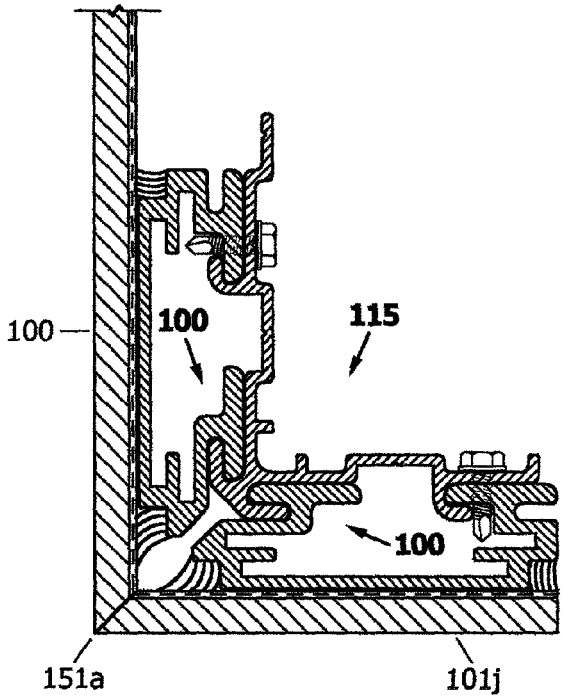
FIG. 54 is a detailed cross-sectional view which shows a method to create a 4" panel edge return with a full miter joint and which will simulate a 4" slab thickness.

FIGS. 22 and 23 illustrate the edge clips 122 and 123 which are used to create a return edge on a panel 101 as shown in FIGS. 51 and 52. The stone panels are full-mitered and cemented together with a matching color epoxy to create an almost invisible joint for the purpose of simulating a much thicker stone panel. Larger edge returns are created using other attachment clips 112 and 115 as shown in FIGS. 53 and 54.

As illustrated in FIG. 22, the vertical leg 122*a* of the edge clip 122 contains two up-turned hooks 122*b* forming two female sockets 122*c* which serve to capture the two flanges 100*a,b* of the perimeter frame 100. The V-shaped screw guide 122*d* on the vertical leg opposite the upper hook locates the screw which attaches the edge clip 122 to the frame 100. The vertical leg 122*a* turns horizontally 122*e* in order to create the desired dimension of the edge return and then turns down and establishes a vertical wall 122*f* which serves as one wall of a pocket for a caulked joint between an adjoining panel as seen in FIG. 52. The recessed reveals at 122*h* and 122*k* provide to receive beads of silicone adhesive for attachment of a small section of stone panel 101 to serve as the edge return which is positioned on the mounting surface 122*j* of the clip.

FIG. 23 illustrates a similar edge clip 123 to the edge clip 122 described in FIG. 22 with the shape adjusted to provide a smaller mounting surface 123*a* to create a smaller edge return as shown in FIG. 51.

Figure 24:
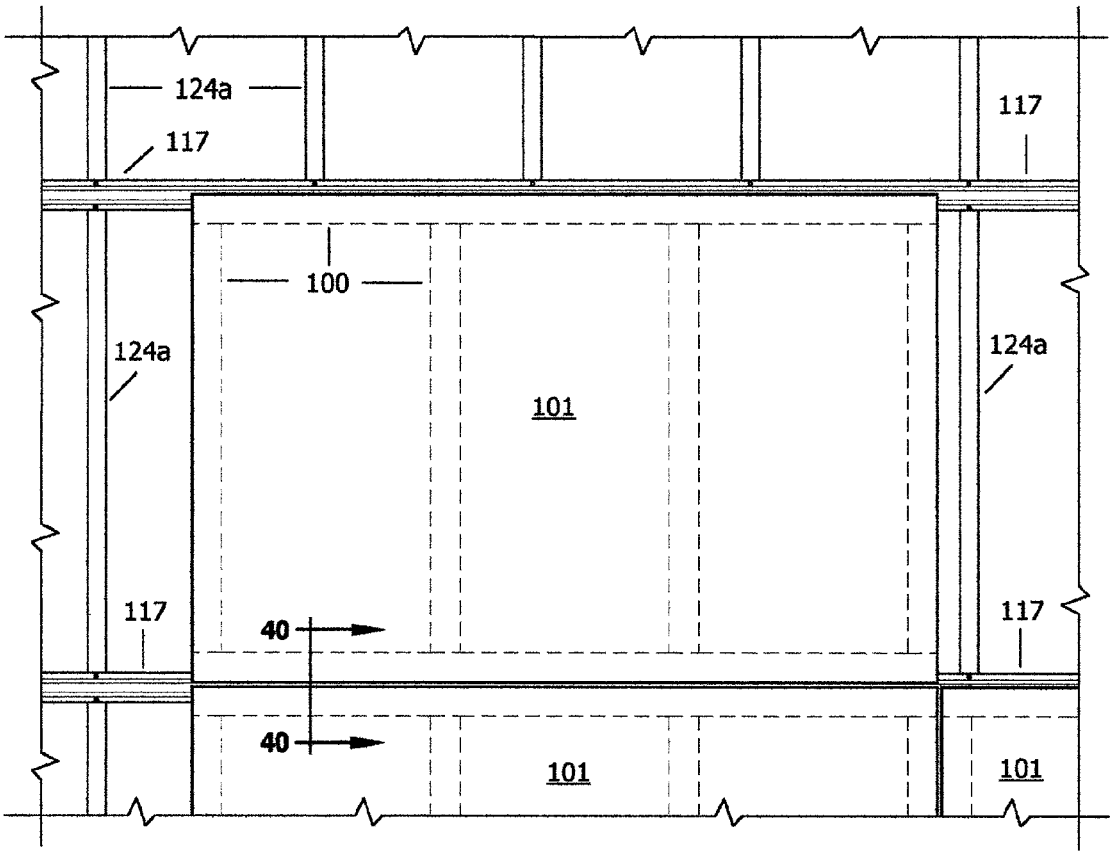
FIG. 24 is partial elevational view showing a typical wall panel according to the invention supported on runners attached to a building substrate and panel perimeter frames and stiffeners on the back of the panel are shown with dotted lines.

FIG. 24 illustrates a typical wall panel 101 as indicated in FIG. 1. The wall panel 101 is supported top and bottom by a pair of spaced continuous runners 117 which are fastened to the building substrate 124*a* which, in this case, is represented by steel studs, zee sections or hi-hat sections. The flanges 100*a* and 100*b* of the top and bottom panel frames 100 are nested in the female sockets 117*c* of the runners 117 as shown in FIG. 40 which provides continuous support at top and bottom of the panel 101 to carry the dead load (weight) of the panel and the live loads (lateral loads) are resisted by a combination of the horizontal frames 100 and the vertical frames 100 and stiffeners 100. The perimeter frames 100 and the intermediate stiffeners 100 which occur on the backside of the panel 101 are shown dotted.

Figure 25:
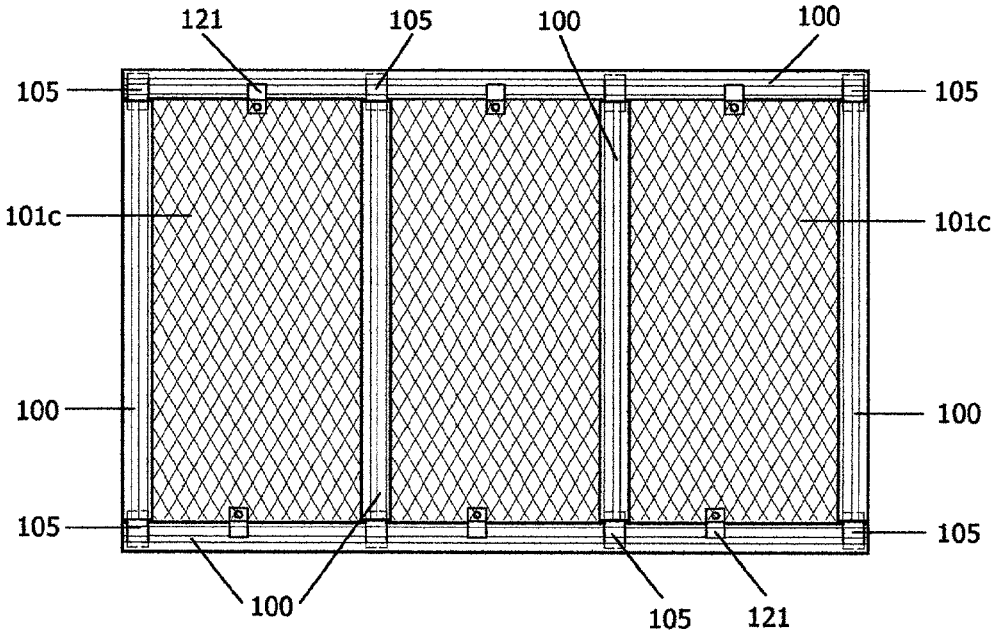
FIG. 25 is an elevational view of the back side of a wall panel showing the panel perimeter frames, the intermediate stiffeners, the splice-connector clips at the intersections of the frames, and the mechanical anchoring clips on the top and bottom frames.

FIG. 25 is an elevational view of the backside or rear of the panel 100 shown in FIG. 24 and shows the arrangement of the perimeter frames 100 and the vertical intermediate stiffeners 100. FIG. 25 also shows the splice-connector clips 105 (refer to FIGS. 5, 30, and 31) which occur at the corner intersections of the perimeter frames 100 and stiffeners 100 and serve to structurally connect the frames 100 in a rigid manner which allows some movement in the parallel plane of the panels 101. This allowed movement in the parallel plane is designed to absorb any stresses within the panel caused by forces such as expansion due to temperature differentials, high windloads, or by seismic forces. FIG. 25 also shows possible locations of the mechanical anchoring clip 121 (refer to FIGS. 35 and 36) which produces a positive mechanical connection between the thin stone veneer panel 101 and the structural framework 100 of the panel 101 which in turn is connected to the building structure. This clip 121 also is designed to allow movement in the plane parallel to the face of the panel 101 in the direction parallel to the frame 100 to which it is attached.

Figure 26:
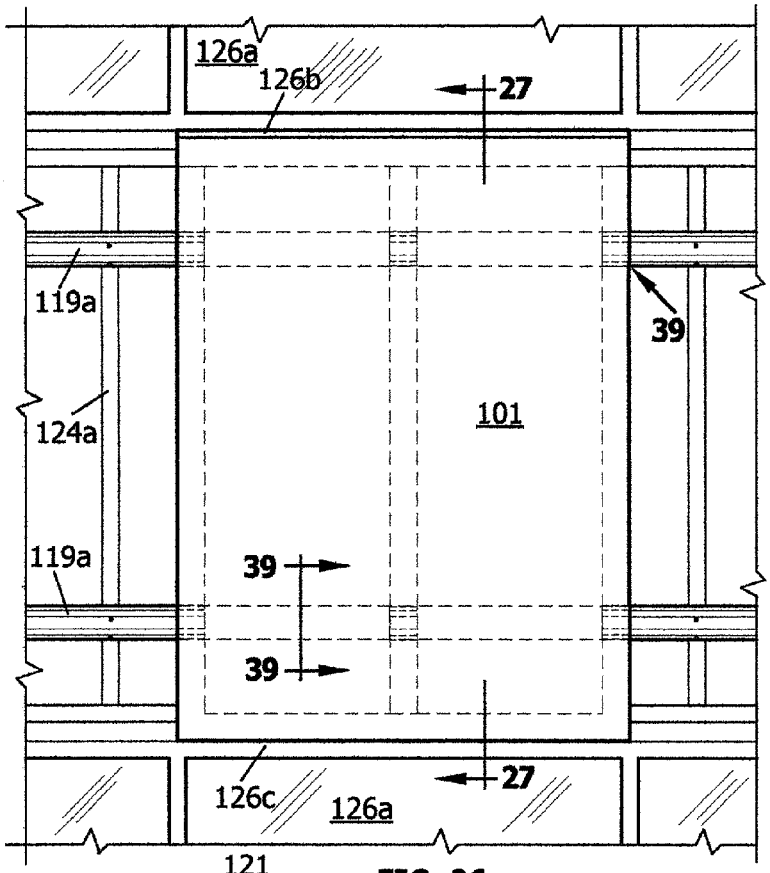
FIG. 26 is a partial elevational view of a typical wall spandrel panel shown installed on runners on a building substrate with the perimeter frames, stiffener, and runners on the backside of the panel shown dotted.

FIG. 26 illustrates a typical spandrel fascia panel 101 between windows 126*a* in a building facade as indicated in FIG. 1 by the labeled arrowed lines 26 and 27. The sill return 126*b* at the top of the panel 101 and the soffit return 126*c* at the bottom of the panel are preassembled and attached to the frames 100 of the fascia panel 101 (refer to FIGS. 38 and 41). The preassembled panel 101 is supported on the horizontal runners 119*a* (refer to FIGS. 19 and 39) which are pre-installed on the building substrate 124*a*. The pre-assembly of the spandrel panel 101 occurs in a shop and includes the attachment of the anchor clips 119*b* mounted on the frames (FIG. 39) and the assembled panel 101 is delivered to the job-site and hung on the double-hook runners 119*a* which have been installed on the building substrate 124*a*. It should be apparent to anyone skilled in the art that with the use of this invention the level of skill required for the installation of these thin stone panels has been simplified and is not very complex and basically requires simple carpentry skills rather than masonry skills and this should provide opportunities to reduce the costs of job-site installation.

Figure 27:
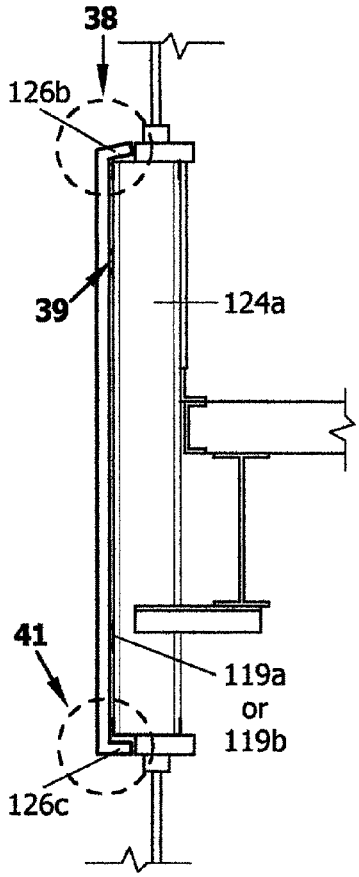
FIG. 27 is a cross-sectional view taken on line 27—27 of FIG. 26 showing how the spandrel panel of FIG. 26 with a pre-assembled sill and soffit are installed on a substrate wall.
Figure 38:
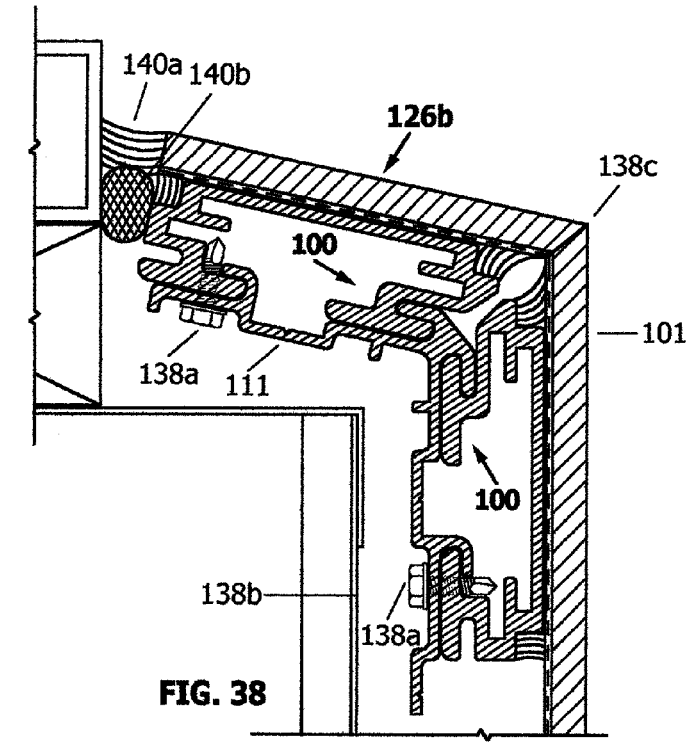
FIG. 38 is a detailed cross-sectional view taken at the location indicated by labeled arrowed lines on FIG. 1 and showing a sloping window sill panel section which is pre-attached to the fascia panel with a full miter joint and a typical caulked joint at the window frame.
Figure 41:
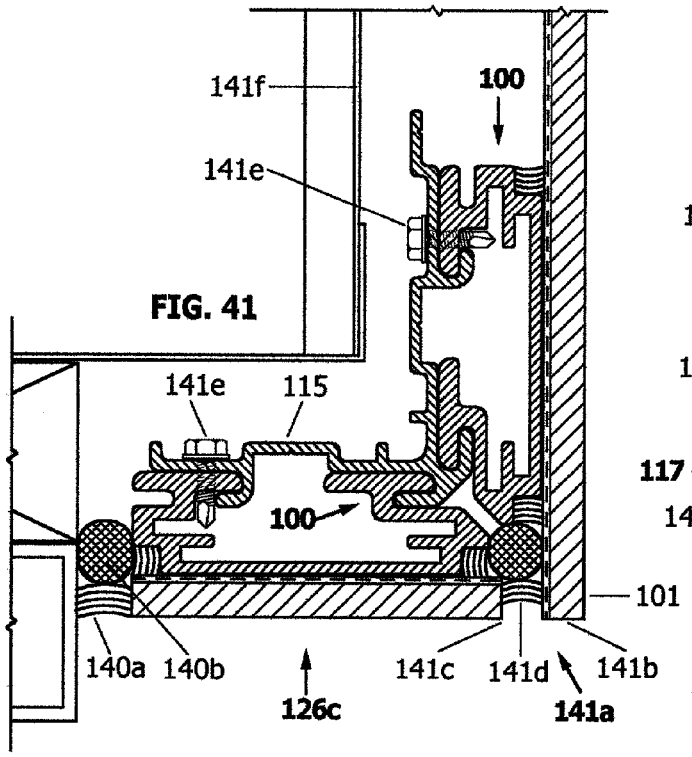
FIG. 41 is a detailed cross-sectional view taken at the location indicated by labeled arrowed lines on FIG. 1 which shows a soffit condition at the window head and bottom of a spandrel panel with the stone sections positioned to provide a water drip at the outside corner and with a recessed caulked joint between panels and a typical caulked joint at the window frame.

FIG. 27 illustrates a profile view of the spandrel panel 101 as described above under FIG. 26 and clearly shows the result of the pre-assembly of the panel returns at the window sill 126*b* and the soffit 126*c*. The location of the double book runners 119*a* and clips 119*b* can be seen and also are illustrated in FIG. 39. Refer also to FIGS. 38 and 41 for detailed sectional views of the sill return 126*b* and the soffit return 126*c*.

Figure 28:
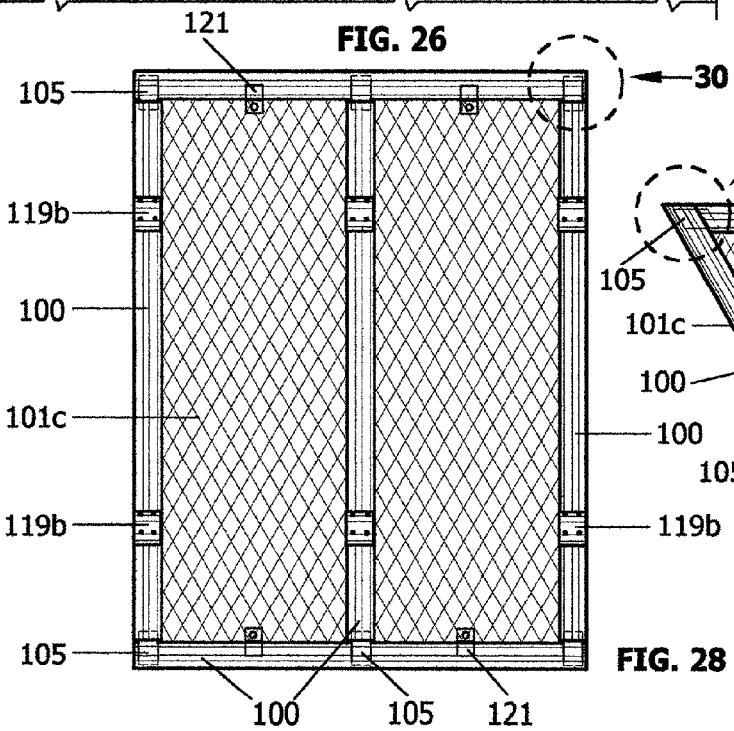
FIG. 28 is an elevational view of the back side of the spandrel wall panel shown in FIG. 26 showing the panel perimeter frames and stiffener, the splice-connector clips at the intersections of frames, the mechanical anchoring clips at the top and bottom frames, and the attachment clips on the vertical frames.

FIG. 28 is an elevational view of the backside of the spandrel panel 101 discussed above under FIG. 26. The detailed explanation made with respect to FIG. 25 also applies to this example but this panel is installed using different anchor clips 119*b* (see FIG. 39) which are shop-attached to the vertical frames 100 and serve to nest in the horizontal runners 119*a* which are installed on the building substrate 124*a*. It should be noted that the panel installation on runners 117 and 119 as described by FIGS. 24 and 26 are essentially slip-connections which will allow some movement of the full panel 101 in the horizontal direction in the plane of the panel 101 in the event of stress due to external forces as previously explained and discussed. This is a very important feature of this invention. Also shown in this view are the locations of the splice connector clips 105 and the possible locations of the mechanical anchor clips 121.

Figure 29:
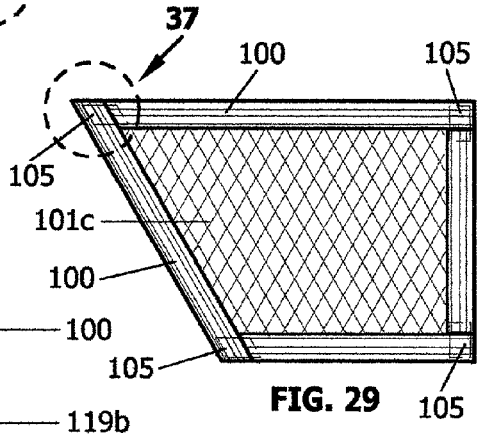
FIG. 29 is an elevational view of the back side of a panel which forms an irregular polygon and shows two frame intersections which are not perpendicular and also shows how the splice connector clips can be shaped to accommodate various angles.
Figure 37:
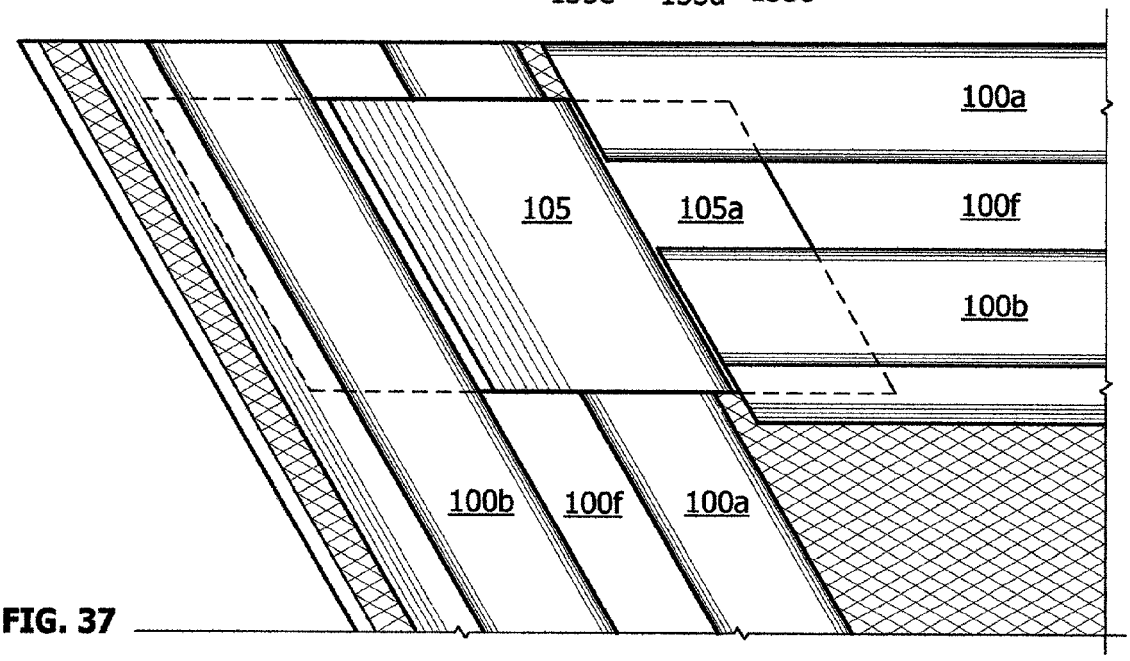
FIG. 37 is a detail plan view showing the splice-connector clip used to connect two perimeter frames which meet at a non-perpendicular intersection.

FIG. 29 is an elevation view of the backside of an irregular polygon shaped panel which produces both acute and obtuse angle intersections of the perimeter frames 100. FIG. 37 illustrates in closer detail how the perimeter frames 100 can be adapted to this non-orthogonal angle intersection and how the splice-connector clip 105 can be cut on a corresponding angle and installed to perform its normal structural function as described under FIG. 25.

Figure 30:
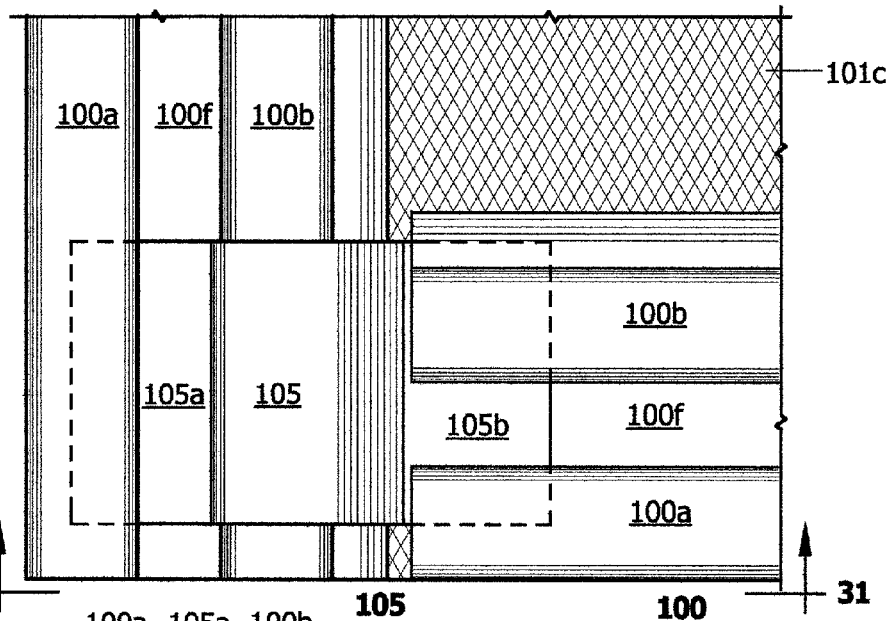
FIG. 30 is a detailed plan view showing the splice-connector clip at a typical perpendicular corner intersection of perimeter frames
Figure 31:
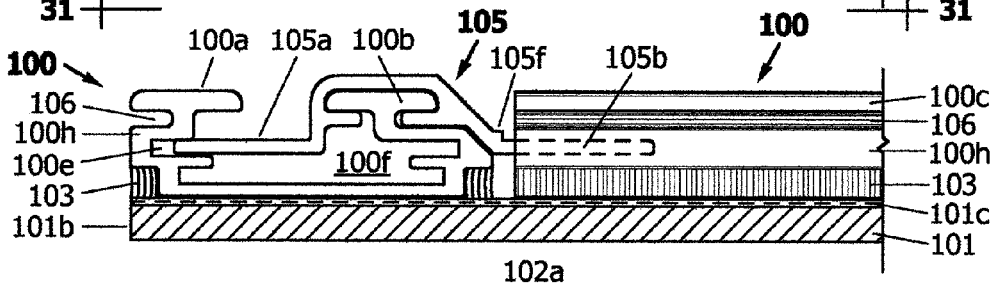
FIG. 31 is an end view taken on line 31—31 of FIG. 30 and shows how the legs of the splice-connector are firmly anchored into both frames and in this view the flush edge of the perimeter frame is positioned at the panel edge and the upper mid-section of the clip envelops the flange at the rebate edge of the perimeter frame.

FIG. 30 is a detailed plan view of a typical corner orthogonal intersection of two perimeter frames 100. The splice-connector clip 105 as shown in FIGS. 30, 31, 33 and 34 makes a structural slip-connection between the two intersecting frames 100. This slip-connection allows some movement in the plane of the panel 101 in two directions along the parallel axes of the two intersecting frames 100. While allowing movement in the parallel plane, this connector 105, due to its designed geometric shape, resists movement in the plane other than the plane of the panel 101. The purpose of this two-way slip connection is to absorb movement within the panel 101 which may be caused by various factors such as temperature differentials, high windloads, or seismic forces and still provide the structural stiffness as required.

FIG. 31 is an end view of FIG. 30 as shown by the section lines 31—31 on FIG. 30 and showing the flush edge 100*h* of the perimeter frame 100 positioned flush with the edge of the stone panel 101*b*. This view shows how the two extended legs 105*a* and 105*b* of the splice-connector clip 105 penetrate the locking spaces 10*e* in each of the two intersecting frames 100 while the mid-portion of the clip 105*c* envelops the flange 100*b* at the rebate edge of the frame 100. As mentioned under FIG. 30, this clip 105 is designed to prevent movement away from the plane of the panel or a bending in the upward or downward directions when viewed as in FIG. 31.

Figure 32:
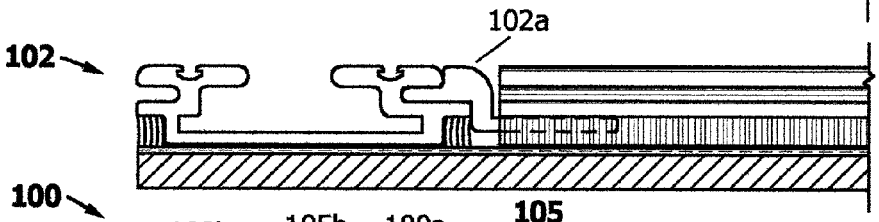
FIG. 32 Prior Art
FIG. 32 is an end view showing prior art RS300 perimeter frame with its interlock clip in order to make a comparison with the present invention shown in FIG. 31.

FIG. 32 is an end view showing the prior art RS300 perimeter frame 102 (FIG. 2) and the prior art interlock clip 102*a* (FIG. 3) in the same juxtaposition of the corresponding members of the present invention as shown by FIG. 31. This view is shown for the purpose of comparison of the present invention with the prior art and to illustrate the structural improvement of the present invention. The interlock clip 102*a* (FIG. 3) is performing a similar function as the splice-connector 105 (FIG. 5) however the latter makes a more positive and stronger structural connection between the two frames than the former. These two views, FIGS. 31 and 32, also offer a visual comparison between the frame of the present invention 100 (FIG. 4) and that of the prior art 102 (FIG. 2) and it is apparent that the present invention provides a more secure connection at this critical corner intersection.

FIG. 33 is similar to FIG. 31 except the orientation of the perimeter frame 100 is reversed to create a rebate edge 100*g* and the frame 100 is recessed on the panel edge 101*a* to accommodate an angled corner intersection with another panel 100 as can be seen in FIGS. 38, 41 thru 45, 47, 48 and 50 thru 54. This view also demonstrates the versatility of the splice-connector 105. Here the orientation of the connector 105 is reversed and the mid-portion of the splice-connector 105 is enveloping the flange 100*a* of the flush edge of the frame 100 which is different from that as shown in FIG. 31.

FIG. 34 illustrates the panel and clip juxtaposition when the undercut frame 108 is utilized to form an inside corner angle intersection of 135 degrees between two panels as can be seen in FIG. 49. In this embodiment the splice-connector 105 is again mounted on and envelops the flange 108*a* of the flush edge 108*h* of the frame 108 but is reversed in orientation from that as shown in FIG. 33 in order to fit the different geometry of the undercut frame 108. The extended leg 105*a* of the splice connector 105 nests into the female socket 108*e* while the opposite leg 105*b* penetrates the interior space 100*f* and the female sockets 101*e* of the other intersecting frame 100 and is locked into position. The biased edge 108*g* and recess 107*a* which receives the silicone bead 103*a*, when aligned with the miter cut edge of the stone panel 101*d*, create the biased undercut panel edge which forms the desired angle intersection with an intersecting panel as illustrated by FIG. 49.

FIG. 35 is a detailed plan view showing the mechanical anchoring clip 121 and FIG. 36 is a cross-sectional view cut through the clip 121 along arrowed lines 36—36 of FIG. 35 and showing the relationship to the other elements which include the perimeter frame 100, the undercut expansion bolt 135, and the top and bottom washers 135*c*. The purpose of this clip 121 is to secure a positive mechanical connection between the thin reinforced stone panel 101 and the aluminum panel frame structure 100 which, in turn, is connected to the building substrate. The physical description and functions of this clip 121 have been previously described under FIG. 21. This mechanical anchoring clip 121 is designed to work in concert with the Keil undercut expansion bolt 135 in order to complete the mechanical connection. The cover, or cage 135*d*, of the expansion bolt 135 is placed into a shallow hole 135*e* which has been drilled in the stone panel 101 with a special drill which cuts a bell-shaped undercut at the bottom of the drilled hole 135*e* and when the socket head bolt 135*a* is screwed into the cage 135*f* the lower part of the cage 135*d* expands into the undercut space 135*e* thus locking it in position. The top part or head of the cage 135*f* is hexagonal shaped and is constrained in the elongated hexagonal-shaped slot 121*a* of the extended leg of the clip 121*b*. The purpose of the slot is to allow some adjustability in the location of the drilled undercut hole. The washers 135*c* are placed above and below the extended leg 121*b* of the clip 121 and the separate bolt head 135*h* is tightened onto the bolt 135*a* to hold the elements firmly in place. When properly installed the expansion bolt 135 will resist both dead loads and live loads and will be assigned a structural pull-out value according to laboratory tests on actual conditions and types of stone which can vary widely. The number of bolts 135 to be applied to a panel 101 will also vary and will depend on the pull-out values assigned to that particular stone and the design windload to be resisted which is established by building codes and is determined by the location of a panel on a particular building and the geographic location of that building and its building code requirements.

FIG. 37 is a detail plan view of a non-orthogonal corner angle intersection of two perimeter frames 100 on a panel 101 showing how the same splice-connector shape 105 (FIG. 5) can be cut on a corresponding angle and perform the same structural function as described under FIGS. 30 and 31. This condition is also illustrated in FIG. 29 which illustrates both an acute and an obtuse angle of intersection between frames.

FIGS. 38 and 40 thru 50 are detailed cross-sectional views taken at locations indicated by the labeled arrowed lines in FIG. 1.

FIG. 38 illustrates how a sloping return 126*b* (as seen in FIG. 25) can be pre-assembled to a fascia panel 101 to function, in this case, as a window sill. Use of the term "pre-assembled" is indicative of a shop assembly of a framed panel with another usually smaller panel which acts as a return on the larger panel. In this example the joint at the intersection of the two stone panels 126*b* and 101 is a full miter joint 138*c* as described under FIGS. 51 thru 54. An alternative joint treatment would be a quirk miter as illustrated in FIG. 43. In this detail view the panel assembly is accomplished by the attachment clip 111 with screw attachment 138*a* to each intersecting frame 100. The interlocking female sockets of the frames 100 with the attachment clip 111 provides a secure and self-supporting assembly. There is no need for a connection to the substrate 138*b* at this detail and that connection is accomplished elsewhere as illustrated in FIGS. 26, 27, and 28.

FIG. 39 illustrates the use of the double-hook clip 119 to anchor a wall panel 101 to a building substrate 139*a*. In this view the hatched section with the upturned hooks 119*a* illustrates a continuous horizontal runner 119*a* fixed to the substrate 139*a* and the non-hatched section is an end view of a short clip 119*b* with hooks turned down which is attached to a vertical panel frame 100 and interlocks with the runner 119*a* as shown. An example of the use of this anchoring clip 119 can be seen in FIGS. 26, 27, 28, 55, and 56.

FIG. 40 illustrates an adjustable horizontal wall runner 117 which supports the bottom and top perimeter frames 100 of two panels which intersect in a planar relationship. The flanges 100*a* of the wall panel frames 100 are captured in the female sockets created by the upturned hooks 117*d* of the runner 117. The inside face 117*b* of the runner 117 is serrated horizontally and has a vertical slotted hole (not shown) every 2" along the length of the runner 117 in order to facilitate the attachment of the runner 117 to the substrate 140*e*. The serrated washer 118 meshes with the runner 117 and is screwed 140*d* to the substrate 140*e* through the slotted hole 117*a*. The meshing of the serrations serves to firmly lock the two pieces together when the center screw 140*d* is tightened. Loosening the screw 140*d* allows the runner 117 to be moved up or down in adjustment and when the final position is obtained the center screw 140*d* is again tightened and the top and bottom screws 140*c* are applied to fix the position of the runner 117 more securely on the substrate 140*e*. This adjustability feature facilitates the installation in the field.

It can be observed in FIGS. 39 and 40 that both the double hook clip 119 and the adjustable wall runner 117 are coordinated to work together in that they both maintain the same dimension (½") between the panel frame 100 and the building substrate 139*a* and 140*e*. There can be occasions when they both are utilized on the same panel or in the same planar wall section of multiple wall panels.

FIG. 41 illustrates a right angle return 126*c* (as seen in FIGS. 26 and 27) pre-assembled on a fascia panel 101 to create a soffit return 126*c* at a window head. In this case a rain drip 141*a* is created by extending the fascia stone 141*b* downward to the level of the outside face of the stone on the return 126*c*. The edge of the return stone 141*c* is positioned to create a joint 141*a* between the soffit stone 126*c* and the fascia stone 101. The caulking bead 141*d* is then recessed in the joint 141*a* to create the drip 141*a* which is a standard detail in traditional stone construction and is usually accomplished with a sawcut in the much thicker edge of the traditional stone slab. In this detail the pre-assembly is accomplished in a shop by use of the attachment clip 115 with screw attachment 141*e* to the frames 100 of the intersecting panels 101 and 126*c*. The interlocking female sockets of the frames 100 with the attachment clip 115 provides a secure and self-supporting assembly. There is no connection to the substrate 141*f* and the assembled panel is anchored to the substrate 141*f* as illustrated in FIGS. 26, 27, and 28.

FIGS. 42 and 43 illustrate a possible treatment at a roof coping at the top of a building wall as indicated by the arrowed lines shown in FIG. 1. The building side or inside edge of the coping shown in FIG. 42 is a pre-assembly with a small return panel 101 attached to the top horizontal coping panel 101*a* which extends to and locks into the female sockets of the attachment clip 112 which has been pre-attached to the outside fascia panel 102*b* as illustrated in FIG. 43. The coping panel 101*a* is fixed in position as shown in FIG. 42 by the attachment clip 115 which is positioned so that its extended leg 115*e* is pointed downward so that it is available to receive the screw 142*d* which fixes the coping panel 101*a* to the building substrate 142*e*. The pre-assembly of the return panel 101 and the coping panel 101*a* is accomplished using the attachment clip 115 with screw attachment 142*f* to the frames 100 of the intersecting panels. The interlocking female sockets of the frames 100 and attachment clip 115 provides a secure and self-supporting assembly. The corner intersection of the panels forms a quirk miter joint as controlled by the geometry of the frames 100 and the clip 115. The backer rod 140*b* and caulking 140*a* can be applied in the shop.

FIG. 43 illustrates the outside edge of the coping example where the fascia panel 101 is pre-assembled with the attachment clip 112 which serves to receive the frame 109 of the coping panel 101. There is no screw attachment necessary between the frame 109 and the attachment clip 112. The nesting of the flange 109*a* and hook 112*d* of the frame 109 and clip 112 will secure the coping panel 101 in position when it is locked by the screw attachment 142*d* as shown in FIG. 42. In this case the caulking 140*a* must be done in the field.

FIG. 44 illustrates a pre-assembled return panel 101 on a fascia panel 101 which then abuts another fascia panel 101 and creates a space between adjacent panels for a caulked joint 140*a* and a backer rod 140*b*. The corner intersection is shown in this case with a typical quirk miter joint however a drip joint as shown in FIG. 41 could be used or a full miter joint as shown in FIG. 54 could be used. The pre-assembly of the return panel 101 and the fascia panel 101 is accomplished using the attachment clip 115 with screw attachment 144*a* to the frames 100 of the intersecting panels. The interlocking female sockets of the frames 100 and the clip 115 provides secure and self-supporting assembly. The caulking 140*a* and rod 140*b* at the quirk miter joint at the pre-assembled corner intersection can be applied in the shop The details FIGS. 43 and 44 are indicated on FIG. 1 by labeled arrowed lines as top and bottom edge details of the same fascia panel. Attachment to the substrate is not shown in these details and it must be assumed that such attachment is provided as in FIG. 39 by the double-hook clips 119 which are attached to the vertical frames of the fascia panels.

FIG. 45 illustrates the intersection of two panels 101 at an angled outside corner of 225 degrees where the attachment clip 116 is screw attached 145*a* to the frame 100 of the lower panel 101 and is firmly locked in position by the male/female nesting of the flanges 100*a* and 100*b* of the perimeter frame 100 with the sockets 116*c* of the attachment clip 116. The assembly is then attached to the substrate 145*c* by screws 145*d*. When the lower sloping panel 101 is anchored to the substrate 145*c* the upturned female sockets 116*c* of the attachment clip 116 provide a nesting for the flanges 100*a* and 100*b* of the upper panel 101.

Figure 46:
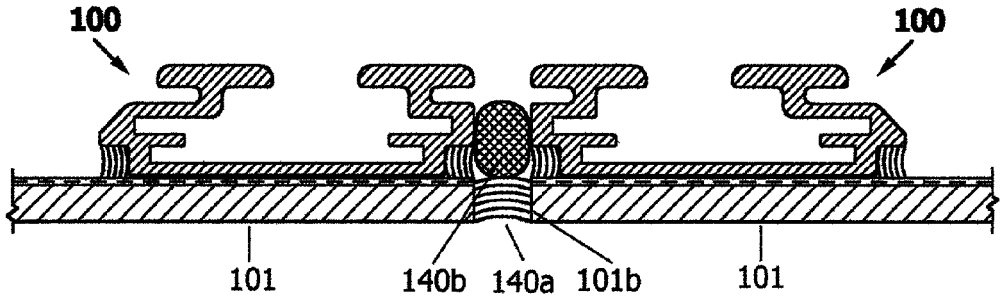
FIG. 46 is a detailed cross-sectional view taken at the location indicated by labeled arrowed lines on FIG. 1 which shows a typical caulked joint between two panels which meet on a parallel plane.

FIG. 46 illustrates a typical vertical joint between two planar panels 101 and demonstrates a basic achievement of the invention which is the provision of a suitable pocket depth between panels for the installation of a compressible polystyrene foam backer rod 140*b*. When properly inserted in the pocket between panels, this backer rod 140*b*, which comes in various sizes, provides the backing at the proper depth for the application of the elastomeric caulking 140*a* as necessary for a watertight joint between the panels 101. This pocket can take different shapes according to various panel intersections as controlled by the attachment clips but the principle remains the same and that is to provide the conditions to obtain a secure watertight facade. The thin stone 101 alone, being so thin, only ⅜", would not have the sufficient depth at the panel edge to form a suitable pocket to support a proper watertight caulked joint.

FIG. 47 illustrates a pre-assembled angle return utilizing the attachment clip 113 to join two panel frames 100 and 109. The return abuts a vertical fascia panel 101 in such manner to create a suitable pocket for a caulked joint 140*a*. In this case the joint 147*a* at the intersection of the stone panels 101 is a full-mitered joint cemented with epoxy colored to match the stone which creates a virtually invisible joint for the purpose of simulating a much thicker stone slab as would be used in conventional stone construction. The pre-assembly of the return 101 and the fascia panel 101 is accomplished with the attachment clip 113 using screw attachment 147*c* to the frames of the intersecting panels.

FIG. 48 illustrates a larger pre-assembled right angle return than those shown in FIGS. 41 and 44. This is accomplished with a wider frame 110 which creates a return of about 8" and which is attached to the frame 100 of the fascia panel 101 by the attachment clip 115 with screw attachments 148*b* to the frames 100 and 110. The interlocking female sockets of the frames 100 and 110 with the attachment clip 115 provides a secure and self-supporting assembly. Referring to the pilaster in FIG. 1 and the labeled arrow indicating this detail (FIG. 48) it can be understood that the 8" return 101 could be placed on both vertical sides of the fascia panel 101 and the resulting three-piece assembly installed as a one-piece pilaster cover or column cover. This is an example of the versatility of the present invention which can adapt itself to many configurations using the aluminum extrusion shapes shown in this application. This frame 110 is not as deep as the other frames 100, 108, 109 in order to reduce the space required for its installation which is sometimes limited. The flange 110*b* at the rebate edge will nest in the female sockets of the various corner angle attachment clips and the flush edge flange 110*a* provides a pocket deep enough to contain the backer rod 140*b* and caulking 140*a* as required. The large central flange 110*c* serves to accept a screw attachment 148*b* and can also serve as a platform for an anchor clip 119 as illustrated in FIG. 39.

FIG. 49 illustrates an inside angled corner where the attachment clip 114 is pre-assembled to the undercut perimeter frame 108 of the lower sloping panel 101*b* by screw attachment 149*c* and that clip 114 is then attached by screw 149*d* to a vertical member of the building substrate 149*e*. This anchors the lower sloping panel 101*b* in place and presents the up-turned female sockets 114*a* to support the flanges 100*a,b* of the lower perimeter frame 100 of the upper panel 101*c*. The geometry of the attachment clip 114 will maintain the distance of the frames 100*a,b* from the substrate so that it will be consistent with that of the other anchoring clips 117 and 119 so that all the anchoring clips can be utilized on the same planar wall section. The clip 114 captures the panels so that a pocket is automatically formed for the backer rod 140*b* and caulking 140*a*. The edge 101*d* of the lower panel is angled to create the intersection with the edge 101*b* of the upper panel and to form the horizontal pocket for the rod 140*b* and caulking 140*a* which is field applied.

FIG. 50 illustrates an outside angled corner of 225 degrees where the attachment clip 113 is pre-assembled to the perimeter frame 100 of the lower panel 101 by screw attachment 150*b*. The upturned female socket 113*a* formed by the hook 113*b* on the upper extended leg 113*c* of the attachment clip 113 nests with the flange 109*a* and supports the perimeter frame 109 of the upper sloping panel 101. This detail illustrates a different joint treatment from that in a similar outside angled corner in FIG. 45. The edge 101*e* of the upper sloping panel 101 is finished in a combination of a bevel cut and a miter cut which provides a horizontal pocket for the rod 140*b* and caulking 140*a* to seal the joint. The edge 101*b* of the lower panel 101 is straight cut.

FIGS. 51, 52, 53, and 54 illustrate various methods to apply different size returns to a fascia panel in order to simulate a much thicker stone slab than the actual ⅜" thin reinforced stone panel being utilized. The sections of stone are brought together in a full miter and even though the panels are firmly locked together by the interlocking shapes of the attachment frames 122, 123, 112, and 115 respectively, the tight stone miter joint is filled with epoxy adhesive of color matching the color of the stone in order to seal the joint from penetrating moisture and to create a virtually invisible joint which will present the appearance of a much thicker slab of stone as often used in architectural designs. There is frequently a preference among architects for heavy or massive stone features in their designs which can be satisfied by the features of this invention as described herein.

FIG. 51 illustrates a shop-fabricated edge treatment in which the pre-assembly of panel sections 101 and 101*f* create an edge return of 1½" for the purpose of simulating the edge of a conventional stone slab 1½" thick. The frame 100 is mounted on a fascia panel 101 and is joined by screw attachment 151*b* to an edge clip 123 mounted with a small section of stone 101*f* to form the edge return. The full miter joint 151*a* is filled with epoxy adhesive, colored to match the stone, which cements the two sections of stone together and creates a virtually invisible joint. The combination of the interlocking extruded shapes 100 and 123 together with the epoxy adhesive joinery produce a solid, strong edge return.

FIG. 52 illustrates a shop-fabricated edge treatment in which the pre-assembly of panel sections 101 and 101*g* create an edge return of 2" to simulate a conventional stone slab 2" thick. The technique is similar to that described above under FIG. 51. In this view the return edge panel 101*g* meets another fascia panel 101 and creates a suitable pocket for the rod 140*b* and caulking 140*a*. The wall 122*f* of the edge clip 122 provides sufficient depth in the pocket to contain the backer rod 140*b* as necessary for the caulked joint. This type of intersection is a common occurrence in conventional stone construction using heavier slabs of stone.

FIG. 53 illustrates a shop-fabricated edge treatment in which the pre-assembly of panel sections 101 and 101*h* create an edge return of 3" in order to simulate a conventional stone slab 3" thick. The technique is similar to that described above under FIG. 51.

FIG. 54 illustrates a shop-fabricated edge treatment in which the pre-assembly of panel sections 101 and 101*j* create an edge return of 4" in order to simulate a conventional stone slab 4" thick. The technique is similar to that described under FIG. 51.

FIGS. 55 and 56 illustrate the condition when the fascia panels 101 must be positioned some additional distance from the building substrate 155*a* than provided by details in FIGS. 39 and 40. This can be accomplished with the adjustable T-clip 120 which has one serrated surface 120*f* on its outstanding leg 120*c* which also contains an elongated slot 120*g* to accommodate the passage of a ¼" bolt 156*a*. This clip 120 (refer to FIG. 20) is designed to mate with itself by bringing the serrated legs 120*f* of the two clips 120 together and securing them with a bolt and nut 156*a* through the elongated slot 120*g*. The meshing of the serrated surfaces 120*f* tends to lock the two clips in position when the bolt 156*a* is tightened thus preventing any slippage. The slots 120*f* provide the in/out adjustability. One section of the T-clip 120*a* is first attached by screws 155*f* to the building substrate 155*a* with the serrated surface 120*f* facing upward and the other section 120*b* is attached in position as shown in FIG. 56 and this second T-clip 120*b* can be moved in or out to a desired position. Once locked in position the outside face 120*h* of the second T-clip 120*b* provides a vertical surface 120*h* for the attachment of a double hook runner 119*a* or the adjustable wall runner 117 as illustrated in FIGS. 39 and 40 respectively.

The detail solution as illustrated in FIGS. 55 and 56 is useful in the over-cladding of an existing wall surface such as one of the most commonly used wall surfaces in the industry, referred to as and EIFS system, which consists of an insulation board 155*e* attached to an exterior gypsum sheathing panel 155*b* on steel studs 155*c*. A thin cement stucco finish 155*d* is applied to the insulation board 155*e*. This type of wall, although very low cost, frequently needs repair. This wall can be over-clad with panels of thin reinforced natural stone 101 using elements of the present invention as illustrated in FIGS. 55 and 56. Pockets can be cut into the existing wall insulation board 155*e* and the first T-clip section 120*a* attached to the steel stud 155*c* through the sheathing 155*b* by screw attachment 155*f* The second T-clip 120*b* is put in place so that its outer face 120*h* is slightly beyond the face of the existing stucco wall 155*d* to allow passage of the double hook continuous wall runner 119*a*. The pocket in the insulation board is then refilled with insulation and sealed against water penetration. The runner 119*a* is attached to the outside face 120*h* of the T-clip 120*b* as illustrated in FIGS. 55 and 56 and the thin reinforced stone wall panels 101 with anchor clips 119*b* attached to its vertical frames 100 are hung in place.

A person skilled in the art should easily ascertain that these same details and features as shown herein could be applied to resolve many other design solutions which can occur in the field of architectural construction and that various changes and modifications may be made without departing from the scope of the invention. It will also be evident to those familiar with the thin stone art and technology, that this invention provides for greater utility and extends the usage of thin reinforced stone.

Each panel may include a natural stone element. Each panel may also include a facing sheet of thin reinforced natural stone adhesively bonded to the frames. The facing sheet of this natural stone is a adhesively bonded to the frames.

What is claimed is:

1. A wall cladding system for covering an exterior building wall, the covering including thin reinforced natural stone supported by the wall cladding system, the system including:

(a). framing means supporting panels, each said panel including a thin natural stone element connected with said framing means for attachment of said thin natural stone element to the exterior building wall;

(b) said framing means including framing members supporting a multiplicity of said panels arranged in closely spaced relation for defining both vertical and horizontal joints between adjacent panels, said multiplicity of panels including a plurality of planar panels each having a plurality of linear edges, each said planar panel having a principal wall forming a portion of the covering of the exterior building wall formed by said wall cladding system;

(c) each of said framing members comprising a top frame member, a bottom frame member and two side frame members and each of said frame members having shapes and profiles constructed of extruded aluminum;

(d) each said planar panel having a facing sheet of thin reinforced natural stone adhesively bonded to said framing members with a double bite of silicone adhesive;

(e) said framing means including slip connection means and two extended legs of a clip fitting into female sockets of an interior space of members forming intersecting framing members for structurally connecting said framing members at the corners of the panel with a slip connection member, each said slip connection member permitting controlled movement in the plane of the panel and along the axis of each said intersecting framing member while maintaining a substantially rigid planar relationship between the intersecting framing members formed by the insertion of said two extended legs of a clip into said female sockets of an interior space of each of the intersecting framing members while a mid-section of the clip envelops one of the flanges of the intersecting framing members;

(f) each said framing member having a top portion, an interior space and a flat bottom section for contacting the thin reinforced natural stone, and including two flanges provided at the top portion of the framing member oriented in the same plane as the face of the planar panel and separated by a space which opens to the interior space of the framing member, and said framing member including two outside edges, one of which is perpendicular to the face of the planar panel forming a flush edge, and an opposite edge forming an angle with the face of the planar panel defining a rebate edge, and both said edges include female sockets for the purpose of engagement with other external devices and having two lower outside corners recessed to receive beads of silicone adhesive to implement an adhesive connection between a facing sheet and the framing members, whereby the framing members at the edges of the planar panel provides structural support and resistance to deformation due to lateral live loads such as wind and seismic forces as well as physical protection for vulnerable edges and corners of the thin natural stone formed of thin fascia sheets; and (g) said planar panel having a perpendicular wall formed at an outside edge of said framing member with the flush edge of the framing member positioned flush with the edge of a fascia panel and the facia panel being situated closely to the adjacent panel, the flush edges of the two panels together create a pocket between them of sufficient depth to provide a space for a backer rod of a compressible polystyrene circular rope to be inserted into said space between two said adjacent panels for the caulking sealant to be applied during construction to create a watertight joint between said adjacent panels.

2. A wall cladding system for supporting panels on an outer or exterior wall of a building, said supporting panels being formed of thin reinforced natural stone, each said panel comprising framing means and a facing sheet of thin reinforced natural stone, the system including:

(a) said framing means including framing members forming a frame supporting a multiplicity of said panels arranged in closely spaced relation defining both vertical and horizontal joints between adjacent panels, said multiplicity of panels including a plurality of non-planar panels each having a plurality of linear edges, each said panel having a principal wall to form a portion of an exterior building wall;

(b) each of said framing members comprising a top frame member and a bottom frame member and two side frame members, each of said frame members each having shapes and profiles constructed of extruded aluminum;

(c) each said non-planar panel including said facing sheet of thin reinforced natural stone adhesively bonded to said frame members with a double bite of silicone adhesive;

(d) slip connection means structurally connecting said framing members at corners of the panel with a slip connection member to form intersecting framing members which allows movement of the panel along the axis of each intersecting framing member while supporting a rigid planar relationship between the intersecting frame members formed by the insertion of two extended legs of a clip into female sockets of an interior space of each of the intersecting frames while a mid-section of the clip envelops one of the flanges of the intersected frame;

(e) each said framing member being characterized by having a flat bottom section for contacting the thin natural reinforced stone, and two flanges provided at the top of the frame oriented in substantially the same plane as the face of the panel faces and separated by a space which opens to an interior space of the frame, and said frame having two outside edges, one of which is perpendicular to the face of the panel forming a flush edge, and one of the opposite edges forming an angle with the face of the panel defining a rebate edge, and both said edges including female sockets for the purpose of engagement with other external devices and having two lower outside corners recessed to receive beads of silicone adhesive to implement an adhesive connection between the face of the panel and the frame;

(f) whereby at least the bottom framing member of the framing members at the edges of the panels provided structural support and resistance to deformation due to lateral live loads such as wind and seismic forces as well as physical protection for the vulnerable edges and corners of the thin reinforced stone;

(g) said framing members at a linear edge form an angled intersection of two non-planar panels to form intersecting panels being oriented to present the rebate edge of the framing members toward the panel edge and, when engaged with an attachment clip, will position the intersecting panels in desired relative locations with respect to each other;

(h) an attachment clip for positioning of the intersecting panels by engaging the framing members of the intersecting panels with said attachment clip, made of extruded aluminum, with the respective sockets and flanges of the frames and the clip meshing in a nesting reciprocal male/female engagement which automatically positions the intersecting panels in the correct relationship;

(i) said attachment clip also controlling the angled intersection of the intersecting panels and the angles and shapes of the various attachment clips which nest with the flanges and sockets of the framing members in a reciprocal male/female engagement whereby correct positioning of the intersecting panels is achieved through a dimensional coordination of the specific placement of a rebate edge framing member on the backside of a facing panel with a specific profiled edge finish applied to the edge of the thin natural stone panel in order to produce a required panel intersection; and (j) said attachment clips automatically positioning two intersecting panels to form a pocket between the panels of sufficient size and depth for the insertion of a compressible polystyrene circular rope to serve as a backer rod for the application of the caulking sealant which creates a watertight joint between panels.

3. A wall cladding system according to claim 1 or 2 and further characterized in that each said panel includes a stiffener member extending between and connected to opposite framing members by means of a splice-connector clip and being adhesively bonded to a back face of the facing panel, and said stiffener being composed of a similar framing member as used at the periphery of the panel and for providing resistance against deflection due to lateral loading caused by high wind pressures, both positive and negative.

4. A wall cladding system according to claim 1 or 2 and further characterized in that attachment clips are utilized to create connections and attachments between one of the panels with another panel.

5. A wall cladding system according to claim 2 wherein the attachment clips include male flanges and female sockets which engage in male/female nesting with the framing members for supporting the required intersection of the framed panels in the correct relationship for automatically creating a desired joint condition.

6. A wall cladding system according to claim 2 or 5 and further characterized in that attachment clips are utilized to pre-assemble in a shop the framed panels with other smaller panel sections to create various panel profiles including edge returns, sill returns, jamb returns, soffit returns, column cover returns, all by means of locking engagement, secured by screws, of the flanges and sockets of the panel frames and attachment clips.

7. A wall cladding system according to claim 6 and further characterized in that said attachment clips are utilized to pre-assemble in a shop an edge return on a framed panel with the intersecting stone edges cut in a full miter and brought to a tight joint filled with epoxy adhesive to create a virtually invisible miter joint in order to simulate a thicker conventional slab of stone as much as 4" thick all by means of the structural support of a locking engagement of the flanges and sockets of the panel frames and the attachment clips as secured by screw attachment.

8. A wall cladding system according to claim 2 and further characterized in that said attachment clips are utilized to pre-assemble in a shop an edge return on a framed panel with the intersecting stone edges cut in a full miter and brought to a tight joint filled with epoxy adhesive to create a virtually invisible miter joint in order to simulate a thicker conventional slab of stone as much as 4" thick all by means of the structural support of a locking engagement of the flanges and sockets of the panel frames and the attachment clips as secured by screw attachment.

9. A wall cladding system according to claim 1 or 2 and further characterized in that a mechanical connection is provided to supplement the adhesive bond between the stone panel and the structure represented by the structural framing member on an edge of the panel by means of an anchor clip for providing a bridge connection between an undercut expansion bolt installed in the back face of the thin stone panel and a flange of a framing member of a panel to permit a slip movement in order to compensate for any movement due to expansion or contraction caused by temperature differentials.

10. A wall cladding system according to claim 1 or 2 and further characterized in that the framed panels are self-contained structural entities and include anchoring clips anchoring the panels loosely to a building substrate, runners attached to the building for permitting some horizontal sliding movement in the sockets and flanges of the panel frames and the various anchorage and attachment clips in the event of building sway movement due to high wind or seismic forces.

* * * * *